US009373342B2

(12) United States Patent
Pilli et al.

(10) Patent No.: US 9,373,342 B2
(45) Date of Patent: Jun. 21, 2016

(54) SYSTEM AND METHOD FOR SPEECH ENHANCEMENT ON COMPRESSED SPEECH

(71) Applicant: Nuance Communications, Inc., Burlington, MA (US)

(72) Inventors: Sridhar Pilli, Fremont, CA (US); Mahesh Godavarti, Cupertino, CA (US); Qian-Yu Tang, Milpitas, CA (US); Jose Lainez, London (GB); Jagadeesh Balam, Campbell, CA (US)

(73) Assignee: Nuance Communications, Inc., Burlington, MA (US)

( * ) Notice: Subject to any disclaimer, the term of this patent is extended or adjusted under 35 U.S.C. 154(b) by 44 days.

(21) Appl. No.: 14/312,074

(22) Filed: Jun. 23, 2014

(65) Prior Publication Data

US 2015/0371653 A1 Dec. 24, 2015

(51) Int. Cl.

| | |
|---|---|
| ***G10L 21/0364*** | (2013.01) |
| ***G10L 19/26*** | (2013.01) |
| ***G10L 25/12*** | (2013.01) |
| *G10L 19/12* | (2013.01) |
| *G10L 25/78* | (2013.01) |
| *G10L 25/93* | (2013.01) |
| *G10L 19/16* | (2013.01) |
| *G10L 25/21* | (2013.01) |

(52) U.S. Cl.

CPC ..... *G10L 21/0364* (2013.01); *G10L 19/26* (2013.01); *G10L 25/12* (2013.01); *G10L 19/12* (2013.01); *G10L 19/173* (2013.01); *G10L 25/21* (2013.01); *G10L 25/78* (2013.01); *G10L 25/93* (2013.01)

(58) Field of Classification Search

None

See application file for complete search history.

(56) References Cited

U.S. PATENT DOCUMENTS

| | | | | |
|---|---|---|---|---|
| 5,341,456 A * | 8/1994 | DeJaco | ..... | G10L 19/24 704/214 |
| 5,884,010 A * | 3/1999 | Chen | ..... | G10L 19/005 704/218 |
| 2009/0265167 A1 * | 10/2009 | Ehara | ..... | G10L 19/265 704/219 |

* cited by examiner

*Primary Examiner* — Jeremiah Bryar

(74) *Attorney, Agent, or Firm* — Mark H. Whittenberger, Esq.; Holland & Knight LLP

(57) ABSTRACT

The present disclosure is directed towards a method for speech intelligibility. The method may include receiving, at one or more computing devices, a first speech input from a first user and performing voice activity detection upon the first speech input. The method may also include analyzing a spectral tilt associated with the first speech input, wherein analyzing includes computing an impulse response of a linear predictive coding ("LPC") synthesis filter in a linear pulse code modulation ("PCM") domain and wherein the one or more computing devices includes an adaptive high pass filter configured to recalculate one or more linear prediction coefficients.

20 Claims, 18 Drawing Sheets

1800

SYSTEM AND METHOD FOR SPEECH ENHANCEMENT ON COMPRESSED SPEECH

TECHNICAL FIELD

This disclosure relates to signal processing systems and, more particularly, to systems and methods for audio speech intelligibility improvements.

BACKGROUND

A formant is a concentration of acoustic energy in or around a particular frequency in a speech signal. Intelligibility of speech is heavily dependent on the audibility of higher formants. However, in the presence of listener noise the higher formants may be masked by the noise and, as a result, speech may become less intelligible. If a reasonable spectrum of listener background noise is available then the speech spectrum may be appropriately modified to make the formants audible. However, that is not always possible.

Typical speech intelligibility improvement algorithms work on pulse code modulated ("PCM") streams. The algorithms spectrally rebalance the signals so that higher formants are boosted with respect to the first formant. Typical problems with intelligibility occur when these higher formants are masked by noise.

An inherent problem with working on PCM streams is that if the input to, and the output from, the algorithm is a compressed bit stream (e.g. adaptive multi-rate ("AMR") or Global System for Mobile Communications-half rate ("GSM-HR") then decoding steps and re-encoding steps have to be performed within the algorithm. The decoding step converts the bitstream to a linear domain (e.g., sample-by-sample) PCM stream, the spectral rebalancing step applies time varying filters to speech and performs spectral tilt and the encoding step converts PCM stream back to the expected bitstream. One issue with this approach is that the decoding and encoding steps degrade the speech quality (i.e., tandem coding effect).

SUMMARY OF DISCLOSURE

In one implementation, a method for speech intelligibility is provided. The method may include receiving, at one or more computing devices, a first speech input from a first user and performing voice activity detection upon the first speech input. The method may also include analyzing a spectral tilt associated with the first speech input, wherein analyzing includes computing an impulse response of a linear predictive coding ("LPC") synthesis filter in a linear pulse code modulation ("PCM") domain and wherein the one or more computing devices includes an adaptive high pass filter configured to recalculate one or more linear prediction coefficients.

One or more of the following features may be included. In some embodiments, the linear prediction coefficients may include at least one of a line spectral frequency ("LSF") and a linear prediction coefficient ("LPC"). The method may further include partially decoding a bit stream associated with the first speech input based upon, at least in part, at least one of the line spectral frequency ("LSF") and the linear prediction coefficient ("LPC"). In some embodiments, the spectral tilt may include a ratio of frame energies between a low-pass and high-pass version of a portion of the first speech input. The adaptive high pass filter may include a two-tap finite impulse response ("FIR") filter. The method may include determining if the first speech signal is a voiced speech signal using an unvoiced speech detection module. The method may further include performing an input power estimation analysis and a gain calculation analysis to determine an input power level and an output power level. The method may also include determining a final speech output based upon, at least in part, a weighted average of an output of the adaptive high-pass filter and the gain calculation analysis.

In another implementation, a system for speech intelligibility is provided. The system may include one or more computing devices configured to receive a first speech input from a first user and to perform voice activity detection upon the first speech input, the one or more computing devices further configured to analyze a spectral tilt associated with the first speech input, wherein analyzing includes computing an impulse response of a linear predictive coding ("LPC") synthesis filter in a linear pulse code modulation ("PCM") domain and wherein the one or more computing devices includes an adaptive high pass filter configured to recalculate one or more linear prediction coefficients.

One or more of the following features may be included. In some embodiments, the linear prediction coefficients may include at least one of a line spectral frequency ("LSF") and a linear prediction coefficient ("LPC"). The method may further include partially decoding a bit stream associated with the first speech input based upon, at least in part, at least one of the line spectral frequency ("LSF") and the linear prediction coefficient ("LPC"). In some embodiments, the spectral tilt may include a ratio of frame energies between a low-pass and high-pass version of a portion of the first speech input. The adaptive high pass filter may include a two-tap finite impulse response ("FIR") filter. The method may include determining if the first speech signal is a voiced speech signal using an unvoiced speech detection module. The method may further include performing an input power estimation analysis and a gain calculation analysis to determine an input power level and an output power level. The method may also include determining a final speech output based upon, at least in part, a weighted average of an output of the adaptive high-pass filter and the gain calculation analysis.

In another implementation, a method for speech enhancement is provided. The method may include receiving, at one or more computing devices, a first speech input from a first user and decoding the first speech input. The method may further include performing speech enhancement on the first speech input to generate an enhanced speech signal. The method may also include receiving the enhanced speech signal at an analysis filter configured to generate an excitation vector. The method may include comparing the excitation vector to an original excitation vector obtained from an original bitstream to determine a final bitstream value and updating a partial encoder based upon, at least in part, the final bitstream value.

One or more of the following features may be included. In some embodiments, comparing may include comparing at least one of an original fixed codebook gain, a fixed codebook index, an adaptive codebook gain, and an adaptive codebook index. In some embodiments, the analysis filter may be computed from the original bitstream line spectral frequency ("LSF"). If the excitation vector and the original excitation vector are within a certain threshold then the original bitstream may be the final bitstream value and if the excitation vector and the original excitation vector are outside of the certain threshold then a new gain is computed prior to generating the final bitstream value.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings may indicate like elements.

DETAILED DESCRIPTION

Embodiments provided herein are directed towards an algorithm that improves speech intelligibility without requiring any estimate of the listener background noise spectrum. In some embodiments, a method of speech enhancement on compressed speech bit streams and a zero delay speech enhancement for arbitrary frame sizes are also provided.

Embodiments of speech intelligibility process 10 may eliminate the tandem coding effect discussed above by partially decoding the speech bit stream (e.g., only the line spectral frequencies ("LSF") and linear predictive coefficients ("LPCs")) and computing the new LSF and LPC that have the spectral tilt incorporated. The process may also be configured to replace the old information in the bitstream pertaining to LSFs and LPCs with the new one. Since speech intelligibility process 10 does not fully decode and re-encode the signal (e.g., it may only recompute the LSFs and LPCs) it has the advantage of lower computational requirements as well. Since, the synthesis algorithm naturally applies post-filtering the speech signal may be automatically smoothed between frames.

Embodiments of speech intelligibility process 10 may utilize a unique way of computing the spectral tilt of the speech spectrum, wherein the "spectral tilt" may refer to an overall slope of the spectrum of a speech signal. In this way, speech intelligibility process 10 may exploit the fact that most of the short term spectral tilt of a speech signal may be captured by the LPC coefficients. Speech intelligibility process 10 may first compute the impulse response of the LPC synthesis filter in the linear PCM domain as samples. Then, it may apply the existing techniques of computing the spectral tilt and spectral rebalancing on the impulse response samples. The LSF and LPCs may be recalculated using the modified spectrally rebalanced impulse response and only the bits describing LSFs and LPCs are replaced.

Figure 1:
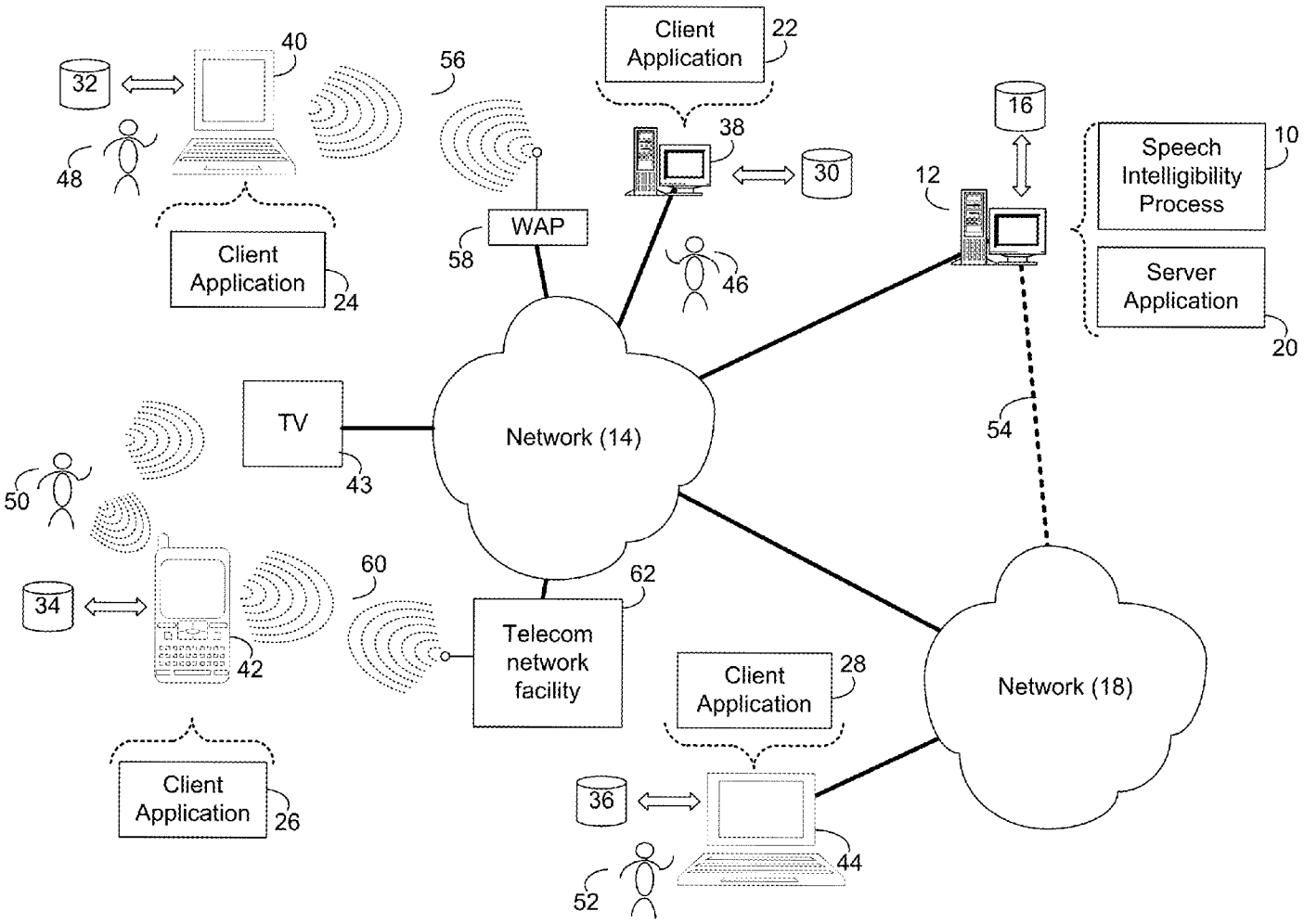
FIG. 1 is a diagrammatic view of an speech intelligibility process in accordance with an embodiment of the present disclosure.
Figure 2:
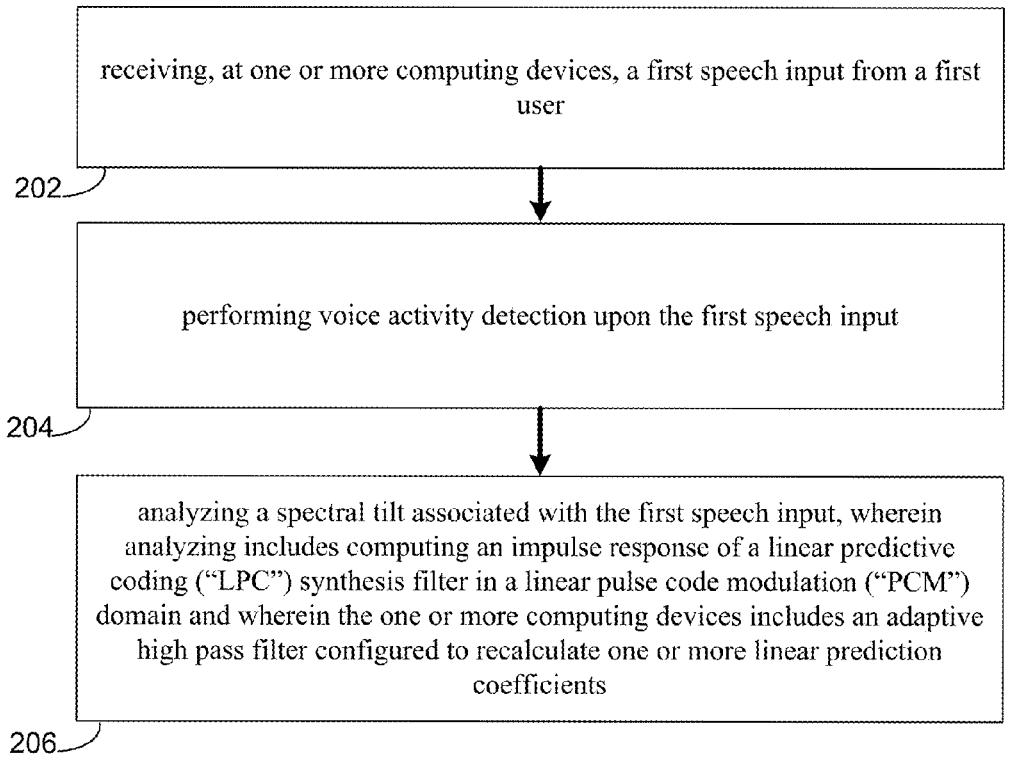
FIG. 2 is a flowchart of a speech intelligibility process in accordance with an embodiment of the present disclosure.

Referring to FIG. 1, there is shown a speech intelligibility process 10 that may reside on and may be executed by computer 12, which may be connected to network 14 (e.g., the Internet or a local area network). Server application 20 may include some or all of the elements of speech intelligibility process 10 described herein. Examples of computer 12 may include but are not limited to a single server computer, a series of server computers, a single personal computer, a series of personal computers, a mini computer, a mainframe computer, an electronic mail server, a social network server, a text message server, a photo server, a multiprocessor computer, one or more virtual machines running on a computing cloud, and/or a distributed system. The various components of computer 12 may execute one or more operating systems, examples of which may include but are not limited to: Microsoft Windows Server™; Novell Netware™; Redhat Linux™, Unix, or a custom operating system, for example.

As will be discussed below in greater detail below and in the Figures, speech intelligibility process 10 may include receiving (202), at one or more computing devices, a first speech input from a first user and performing (204) voice activity detection upon the first speech input. Speech intelligibility process 10 may further include analyzing (206) a spectral tilt associated with the first speech input, wherein analyzing includes computing an impulse response of a linear predictive coding ("LPC") synthesis filter in a linear pulse code modulation ("PCM") domain and wherein the one or more computing devices includes an adaptive high pass filter configured to recalculate one or more linear prediction coefficients. Numerous additional features may also be included as discussed in further detail below.

The instruction sets and subroutines of speech intelligibility process 10, which may be stored on storage device 16 coupled to computer 12, may be executed by one or more processors (not shown) and one or more memory architectures (not shown) included within computer 12. Storage device 16 may include but is not limited to: a hard disk drive;

a flash drive, a tape drive; an optical drive; a RAID array; a random access memory (RAM); and a read-only memory (ROM).

Network 14 may be connected to one or more secondary networks (e.g., network 18), examples of which may include but are not limited to: a local area network; a wide area network; or an intranet, for example.

In some embodiments, speech intelligibility process 10 may reside in whole or in part on one or more client devices and, as such, may be accessed and/or activated via client applications 22, 24, 26, 28. Examples of client applications 22, 24, 26, 28 may include but are not limited to a standard web browser, a customized web browser, or a custom application that can display data to a user. The instruction sets and subroutines of client applications 22, 24, 26, 28, which may be stored on storage devices 30, 32, 34, 36 (respectively) coupled to client electronic devices 38, 40, 42, 44 (respectively), may be executed by one or more processors (not shown) and one or more memory architectures (not shown) incorporated into client electronic devices 38, 40, 42, 44 (respectively).

Storage devices 30, 32, 34, 36 may include but are not limited to: hard disk drives; flash drives, tape drives; optical drives; RAID arrays; random access memories (RAM); and read-only memories (ROM). Examples of client electronic devices 38, 40, 42, 44 may include, but are not limited to, personal computer 38, laptop computer 40, smart phone 42, television 43, notebook computer 44, a server (not shown), a data-enabled, cellular telephone (not shown), and a dedicated network device (not shown).

One or more of client applications 22, 24, 26, 28 may be configured to effectuate some or all of the functionality of speech intelligibility process 10. Accordingly, speech intelligibility process 10 may be a purely server-side application, a purely client-side application, or a hybrid server-side/client-side application that is cooperatively executed by one or more of client applications 22, 24, 26, 28 and speech intelligibility process 10.

Client electronic devices 38, 40, 42, 44 may each execute an operating system, examples of which may include but are not limited to Apple iOS™, Microsoft Windows™, Android™, Redhat Linux™, or a custom operating system.

Users 46, 48, 50, 52 may access computer 12 and speech intelligibility process 10 directly through network 14 or through secondary network 18. Further, computer 12 may be connected to network 14 through secondary network 18, as illustrated with phantom link line 54. In some embodiments, users may access speech intelligibility process 10 through one or more telecommunications network facilities 62.

The various client electronic devices may be directly or indirectly coupled to network 14 (or network 18). For example, personal computer 38 is shown directly coupled to network 14 via a hardwired network connection. Further, notebook computer 44 is shown directly coupled to network 18 via a hardwired network connection. Laptop computer 40 is shown wirelessly coupled to network 14 via wireless communication channel 56 established between laptop computer 40 and wireless access point (i.e., WAP) 58, which is shown directly coupled to network 14. WAP 58 may be, for example, an IEEE 802.11a, 802.11b, 802.11g, Wi-Fi, and/or Bluetooth device that is capable of establishing wireless communication channel 56 between laptop computer 40 and WAP 58. All of the IEEE 802.11x specifications may use Ethernet protocol and carrier sense multiple access with collision avoidance (i.e., CSMA/CA) for path sharing. The various 802.11x specifications may use phase-shift keying (i.e., PSK) modulation or complementary code keying (i.e., CCK) modulation, for example. Bluetooth is a telecommunications industry specification that allows e.g., mobile phones, computers, and smart phones to be interconnected using a short-range wireless connection.

Smart phone 42 is shown wirelessly coupled to network 14 via wireless communication channel 60 established between smart phone 42 and telecommunications network facility 62, which is shown directly coupled to network 14.

Figure 3:
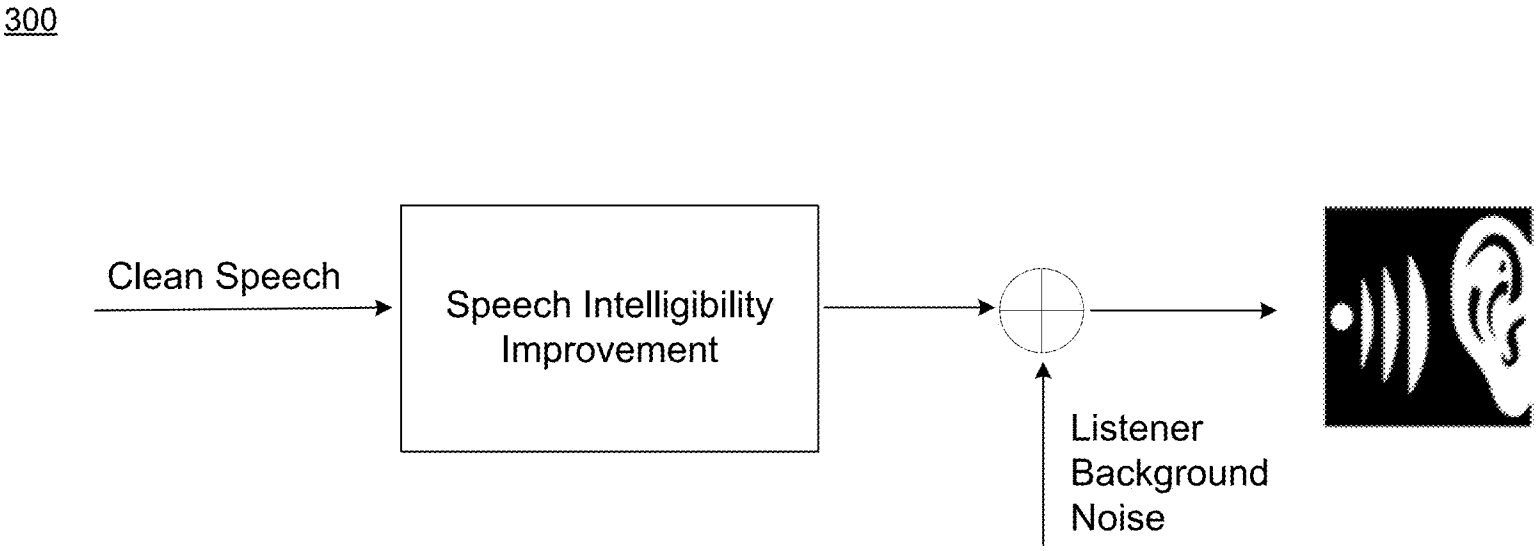
FIG. 3 is a diagrammatic view of a speech intelligibility process in accordance with an embodiment of the present disclosure.
Figure 4:
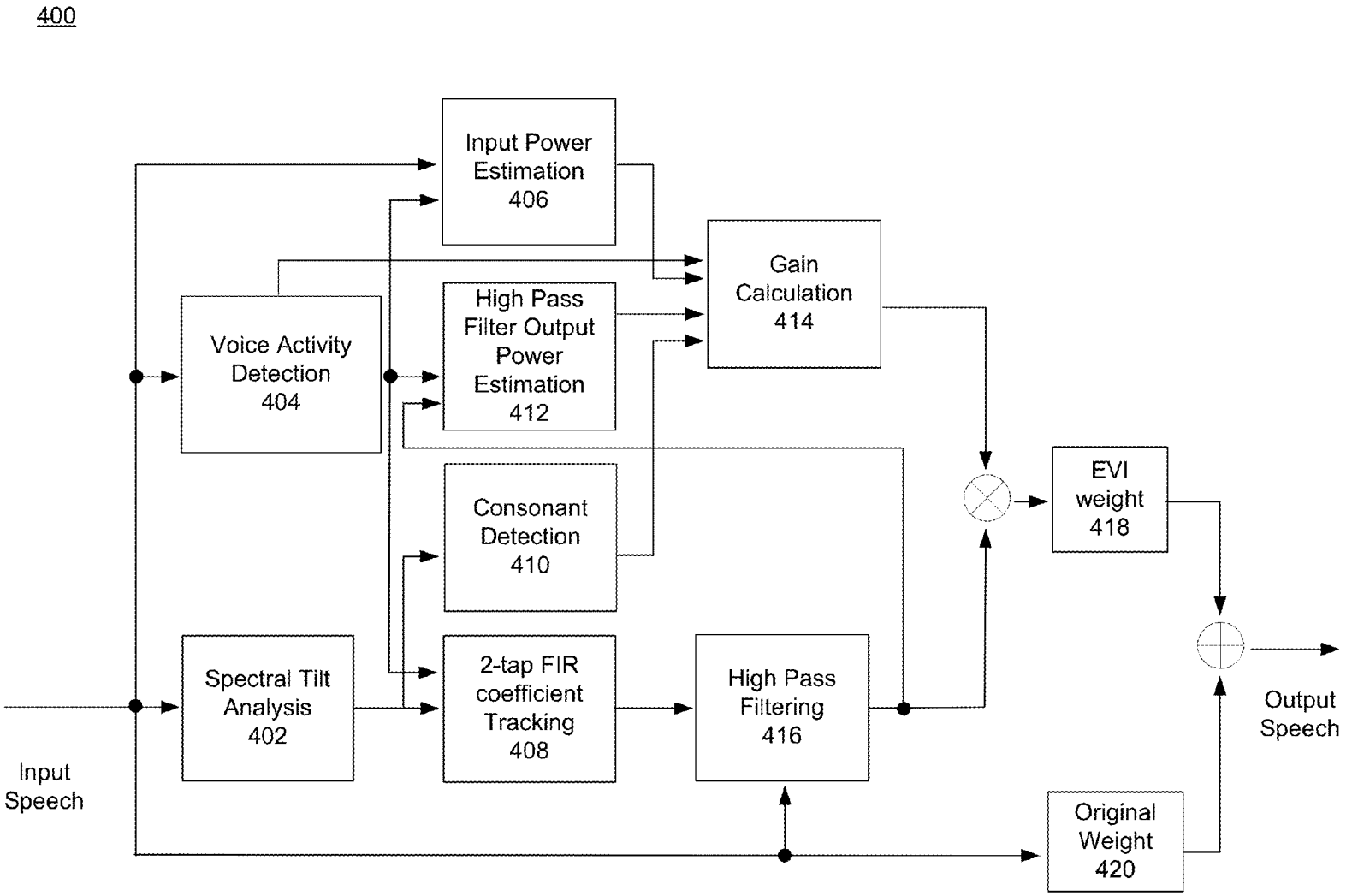
FIG. 4 is a diagrammatic view of an embodiment of a speech intelligibility process in accordance with an embodiment of the present disclosure.

Referring now to FIGS. 3-4, embodiments consistent with speech intelligibility process 10 that depict speech pre-processing for improving intelligibility at the near-end are provided. Preprocessing of speech to improve its intelligibility in adverse conditions is an important problem in the wireless communication industry. Mobile technology calls often occur in noisy environments making the conversation difficult for both the far-end and near-end talkers. A large amount of discriminative information for consonants may be carried in the higher formants. Since speech in general has a low pass characteristic, in the presence of background noise the higher formants may be masked and the discriminative ability takes a hit. While noise suppression techniques with intelligibility criterion can improve clarity for the far end listener, speech pre-processing techniques may be employed to improve intelligibility at the near end.

Embodiments of the present disclosure may provide an inexpensive and effective algorithm (e.g., Enhanced Voice Intelligibility algorithm (EVI)) to improve the intelligibility of speech in wireless networks. Accordingly, speech intelligibility process 10 may be configured to flatten the speech spectrum, thus raising the higher formants, by applying a time-varying high-pass filter to the speech. This is different from previous approaches in that the high-pass filter used herein may not be a fixed filter but an adaptive filter, the coefficients for which may be recalculated every frame.

As shown in FIG. 4, embodiments of speech intelligibility process 10 may include a number of modules and/or components, which may be implemented in software, hardware, firmware and/or combinations thereof. An input speech signal may be received at one or more of spectral tilt analysis module 402, voice activity detection ("VAD") module 404, and input power estimation module 406. The output of VAD module 404 may be transmitted to input power estimation module 406, high pass filter output power estimation module 412 and two tap finite impulse response ("FIR") coefficient tracking module 408. The output of spectral tilt analysis module 402 may be transmitted to two tap finite impulse response ("FIR") coefficient tracking module 408 and to consonant detection module 410. Gain calculation module 414 may receive inputs from modules 406, 408, 410, and 412 prior to providing an input to the multiplier. High pass filter 416 may receive inputs from two tap finite impulse response ("FIR") coefficient tracking module 408 as well as the original input speech signal. The output of high pass filter 416 may be provided to high pass filter output power estimation module 412 as well as to the multiplier. Appropriate weighting may be applied via EVI weight module 418 and original weight module 420 prior to generating the output speech. Each of these modules and the operation of overall speech intelligibility process 10 is discussed in further detail below.

In some embodiments, and with reference to voice activity detection module 404, speech intelligibility process 10 may use one or more voice activity detector ("VAD") algorithms in order to accurately detect both speech and non-speech portions and also to maintain a history of the amount of talking carried out by each talker. Additional information regarding VAD may be found in United States Patent Publication Number 2011/0184732 having an application Ser. No. 13/079,705, which is incorporated herein by reference in its entirety. Additionally and/or alternatively, speech intelligibility process 10 may utilize noise reduction, echo cancellation and level control enhancements in conjunction with audio conferencing on the same device.

In some embodiments, speech intelligibility process 10 may be a purely time-domain based algorithm, thus avoiding the need for employing fast-fourier transforms ("FFT") or inverse fast-fourier transforms ("IFFT") for intelligibility enhancement. Moreover, in some embodiments of the present disclosure the time-varying high-pass filter may include only two taps, which may significantly increase efficiency of the process.

In some embodiments, VAD module 404 may perform a check of input signal power. This approach may assume that the input speech has very high signal-to-noise ration ("SNR") (i.e. clean speech) to be reliable. For low SNR input speech signals a more sophisticated VAD algorithm can be used if desired.

$$VAD = \begin{cases} 1 & \text{if } \frac{1}{\text{frame_size}} \sum_{n=1}^{frame_size} s(n)^2 > threshold_{VAD} \\ 0 & \text{Otherwise} \end{cases}$$

In some embodiments, the spectral tilt γ, may refer to a ratio of frame energies of low pass and high pass versions of the speech signal for that frame. The low-pass and high-pass filters may be selected to be first order FIR filters to keep the computational cost low. The spectral tilt may be a positive number usually lying between 0 and 1 for voiced frames, closer to 1 and occasionally greater than 1 for unvoiced frames. The two tap filter [h(0) h(1)] may be selected such that the first filter tap h(0), is always equal to 1. The second filter tap h(1) may be initially set to h(1)=−(1−γ) and then may be compared with a threshold (e.g., a negative number close to zero). It may be reset to zero if the threshold is exceeded. Note that, the greater the value of h(1) (i.e. less negative) the greater the energy in the higher frequencies for that particular frame. In some embodiments, h(1) may be reset to zero for those frames because certain types of unvoiced speech sound best if left alone. This may also ensure that EVI algorithms if operating in tandem do not greatly distort the speech.

In some embodiments, the filter obtained using this approach may be interpolated with the history to smooth the filtering operation and prevent artifacts. Since h(0) is always equal to 1 only the second coefficient has to be interpolated.

$$f(1) = \begin{cases} (1-\alpha_f)f(1) + \alpha_f h(1) & \text{if } VAD = 1 \\ f(1) & \text{Otherwise} \end{cases},$$

$$f(0) = h(0)$$

In some embodiments, the input power estimation may follow the first order averaging rule. Let, $$p_I = \sqrt{\sum_{n=1}^{frame_size} s(n)^2 / \text{frame_size}}$$

then,

-continued $$P_I = \begin{cases} (1-\alpha_p)P_I + \alpha_p p_I & \text{if } VAD = 1 \\ P_I & \text{Otherwise} \end{cases}$$

In some embodiments, two tap filter obtained above (e.g. f(1)) may be used to enhance the higher formants. The enhancement may be performed by passing the speech signal through the two-tap FIR filter:

$$s_{HF}(n) = \sum_{k=0}^{1} f(k) * s(n-k)$$

In some embodiments, power estimation of the output of the high pass filter may follow the same rule as the power estimation of the input signal. Let, $$p_O = \sqrt{\sum_{n=1}^{frame_size} s_{HF}(n)^2 / \text{frame_size}}$$

then, $$P_O = \begin{cases} (1-\alpha_p)P_O + \alpha_p p_O & \text{if } VAD = 1 \\ P_O & \text{Otherwise} \end{cases}.$$

In some embodiments, the unvoiced speech detection module may employ two detectors. The first detector may use h(1) described above to make the voicing decision. If h(1) is above a certain threshold ($threshold_{UVD}$) it is decided that the frame is unvoiced. A large negative h(1) (i.e. closer to −1) means that the speech signal has very few high pass components and is more vowel-like or voiced. The second detector may calculate a measure of number of zero crossings to decide whether the segment of speech is unvoiced. The metric needs to keep track of the input power, which is different from the input power estimation described above as follows:

$$P_{UV} = (1-\alpha_{UV}) * P_{UV} + \alpha_{UV} * p_O$$

$$\text{where } p_O = \sum_{n=1}^{frame_size} |s(n)|.$$

The metric also needs the following quantity $$d = \sum_{n=2}^{frame_size} |s(n) - s(n-1)|.$$

The metric $metric_{UV}=d/P_{UV}$, may be compared with a threshold to decide whether the frame is unvoiced. If the metric is greater than the threshold then the detector may identify the frame as unvoiced. If either of the two detectors indicates the presence of unvoiced speech then the frame is classified as unvoiced.

In some embodiments, the main task of gain calculation module is to ensure that the output power is the same as that of the input. However, the algorithm applies a power boost to those frames that have been identified as unvoiced frames as the spectrum for those frames cannot be made any flatter using a high pass filter. The gain calculation module may receive inputs from VAD 404, input power estimation module 406, high pass filter output power estimation module 412, and unvoiced speech detection module.

Let $p_O$, $p_I$, $P_I$, $P_O$ be as defined above, $g_I = P_I/P_O$ and $p_{i,max}$ be the maximum overall $p_o$ until the current frame then:

$$G_1 = \begin{cases} 1 & \text{if } VAD = 0 \\ g_I & \text{if } VAD = 1 \end{cases}$$

$$G_2 = \begin{cases} G_1 & \text{if voiced speech} \\ K * G_1 & \text{if unvoiced speech} \end{cases}$$

$$G_3 = \begin{cases} G_2 & \text{if } G_2 * p_o \le p_{i,max} \\ p_{i,max} / p_o & \text{if } G_2 * p_o > p_{i,max} \end{cases}$$

$$G_4 = \begin{cases} G_3 & \text{if } G_3 \le K \\ K & \text{if } G_3 > K \end{cases}$$

$$G_{final} = (1 - \alpha_G) G_{final} + \alpha_G G_4$$

In some embodiments, the final speech output may be obtained by taking a weighted average of the high-pass filter output multiplied by $G_{final}$ and the original speech.

In other words, the final speech output is given by:

$$s_{FINAL}(n) = (1 - \alpha_{EVI}) * s(n) + \alpha_{EVI} * G_{final} * S_{HF}(n)$$

where $\alpha_{EVI}$ ($0 \le \alpha_{EVI} \le 1$) is the amount of EVI contribution desired.

Embodiments of speech intelligibility process 10 may provide a low-complexity time-domain based algorithm that is very effective in improving speech intelligibility. Speech intelligibility process 10 may utilize an adaptive high-pass filter as discussed above. Some speech samples that already have a flat structure to the spectrum may actually see degradation in intelligibility if high-pass filtered. Therefore, it makes sense to make the high-pass filter a function of the input speech spectrum, so that it may only applied when necessary.

Embodiments of speech intelligibility process 10 may be configured to eliminate musical noise effects that can arise from selective frequency domain boosting of higher order formants. Speech intelligibility process 10 may also avoid explicit formant tracking and hence it may not have to expend any computation in identifying the formants. Speech intelligibility process 10 may not require a perceptual listening model or computation of masking curves, which also contributes to the low-complexity nature of the algorithm.

In some embodiments, speech intelligibility process 10 may be a purely signal processing based algorithm and, as a result, may require very little speech domain expertise. Speech intelligibility process 10 may increase the intelligibility of speech by focusing purely on the speech signal itself thus avoiding any dependence on tracking listener background noise. In some cases, obtaining a good estimate of the listener background noise may be difficult (e.g., when the algorithm is deployed in the middle of a wireless network).

In some embodiments, the low-complexity nature of speech intelligibility process 10 may be used for real-time speech enhancement (e.g., for very low power devices like mobile phones, cochlear implants, etc.). The fact that the algorithm may be dependent only on the input speech that it is processing indicates that it may be a very good candidate for off-line pre-processing of speech when the environmental conditions under which the speech is heard are not known. Moreover, speech intelligibility process 10 may achieve an intelligibility improvement despite not increasing the overall signal level.

Referring now to FIGS. 5-14, embodiments of the present disclosure may include a system and method for performing speech enhancement on compressed bit streams. With the advent of VoIP, speech may be transmitted across networks in highly compressed form (e.g. adaptive multi-rate ("AMR"), G.729, etc.). Traditional network based speech enhancement products that worked on G.711 bit streams (little loss of degradation when converting from G.711 to linear samples or vice versa) could no longer work directly on the compressed speech bitstreams without an explicit decoding and re-encoding step. Re-encoding may be required because the speech enhancement products can not interfere with network operation and the products need to be completely transparent at the packet level (e.g., an AMR frame can only be replaced with an enhanced AMR frame). A speech codec bitstream would need to be first decoded to generate linear 16-bit samples, have speech enhancement performed and resulting speech converted back to the codec bitstream before being delivered back to the network. The decoding and re-encoding step may introduce degradation due to tandem coding effects.

Figure 5:
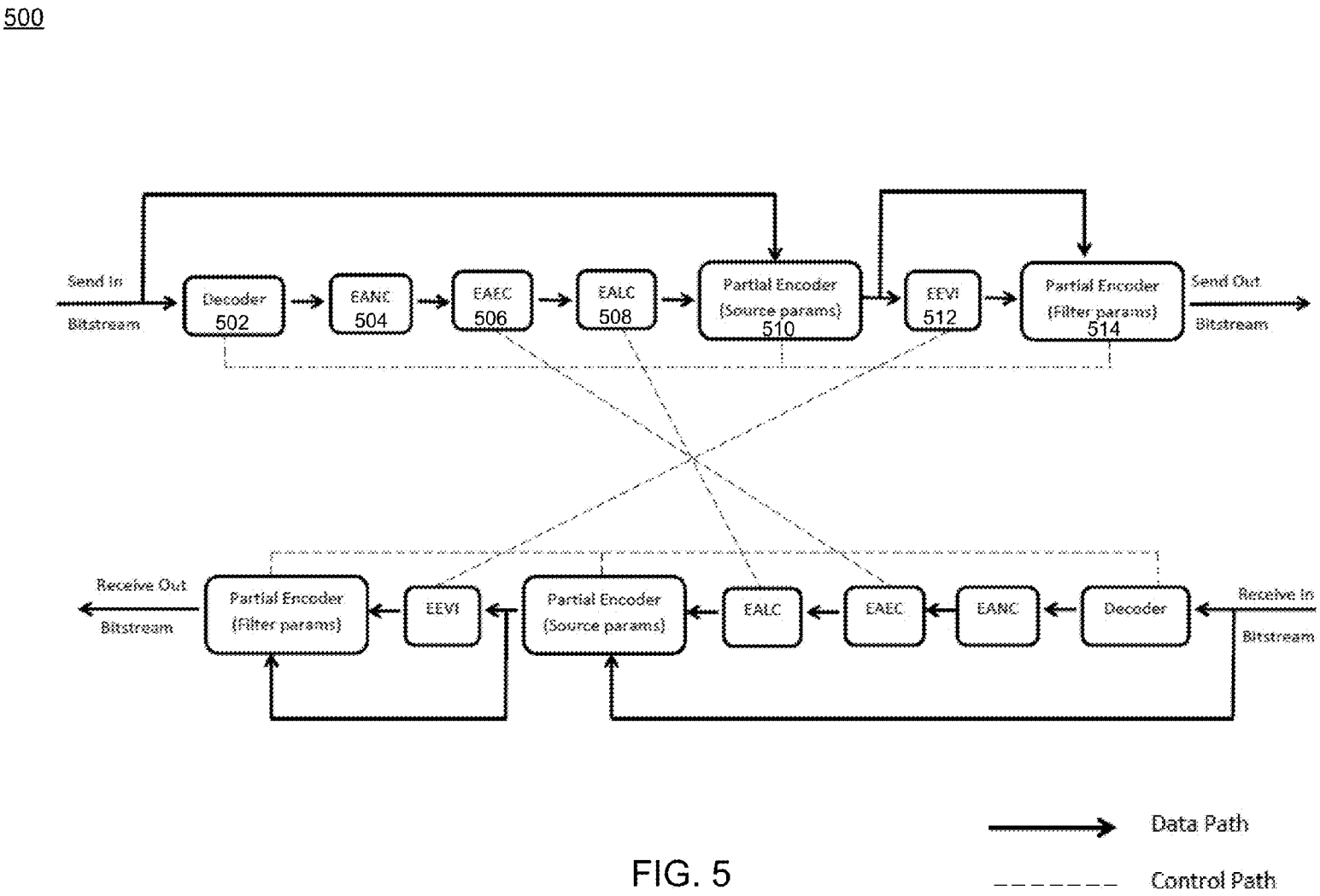
FIG. 5 is a diagrammatic view of a speech intelligibility process in accordance with an embodiment of the present disclosure
Figure 6:
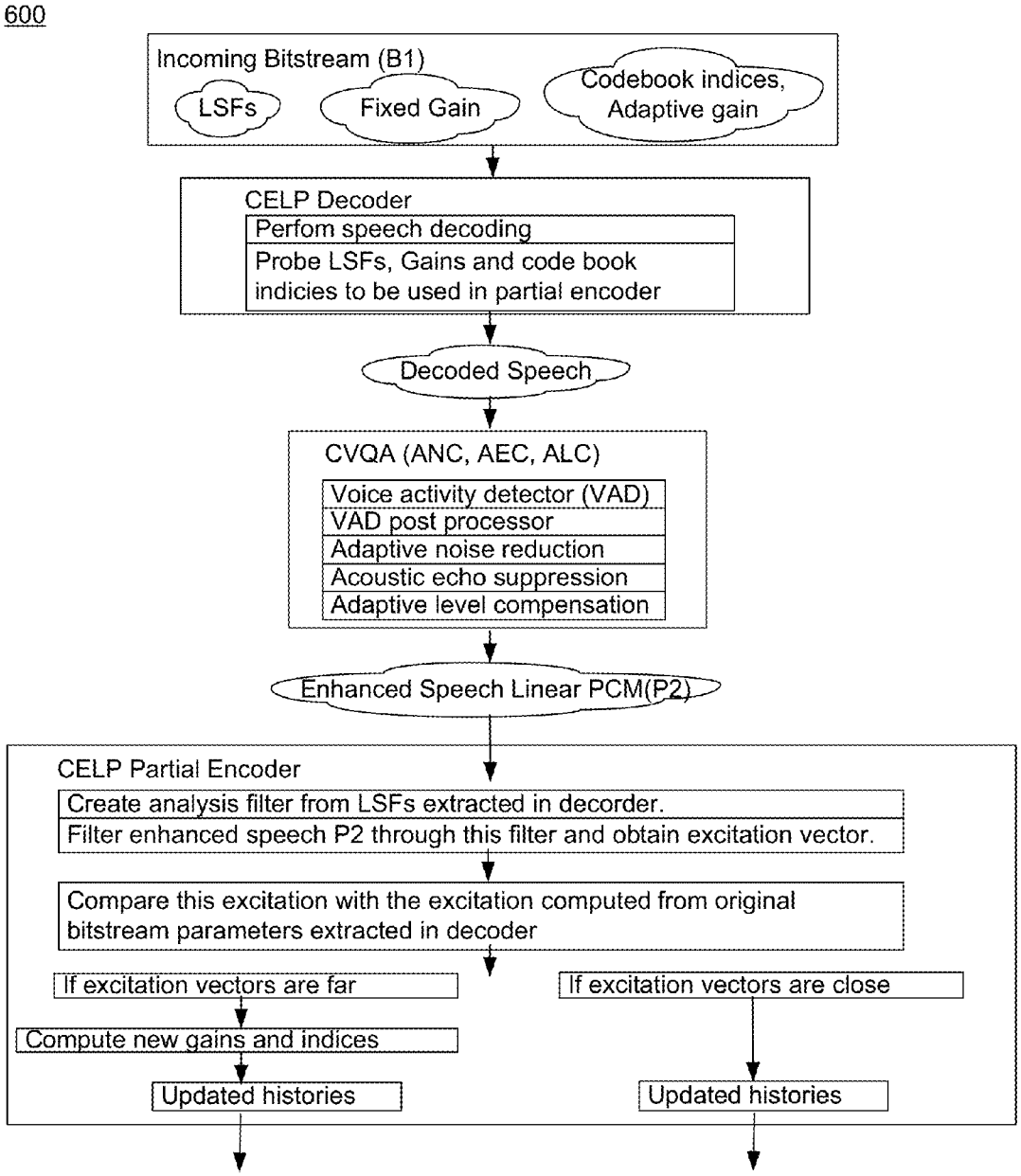
FIG. 6 is a diagrammatic view of an embodiment of a speech intelligibility process in accordance with an embodiment of the present disclosure.
Figure 7:
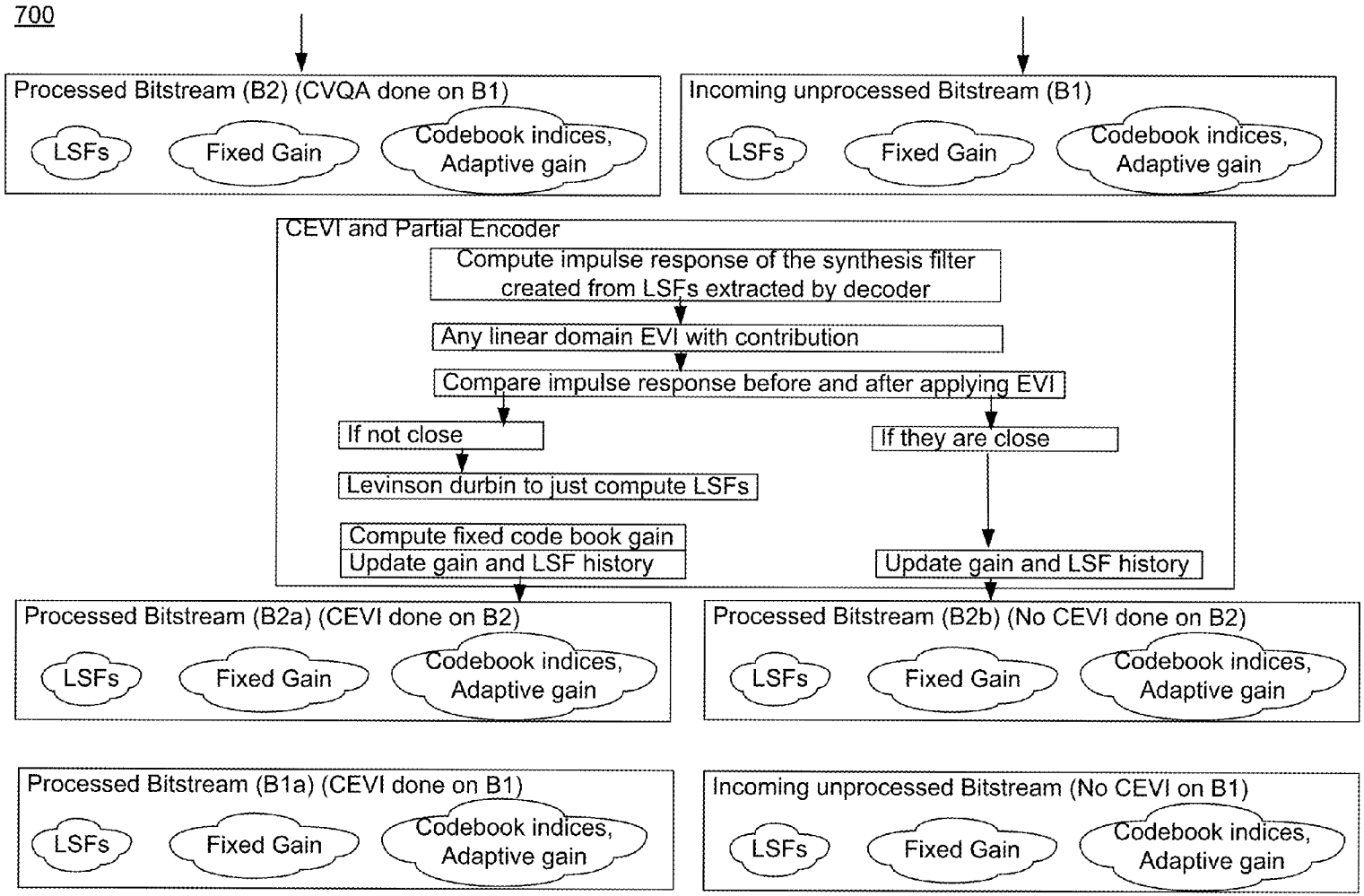
FIG. 7 is a diagrammatic view of the embodiment of FIG. 6 in accordance with an embodiment of the present disclosure.
Figure 8:
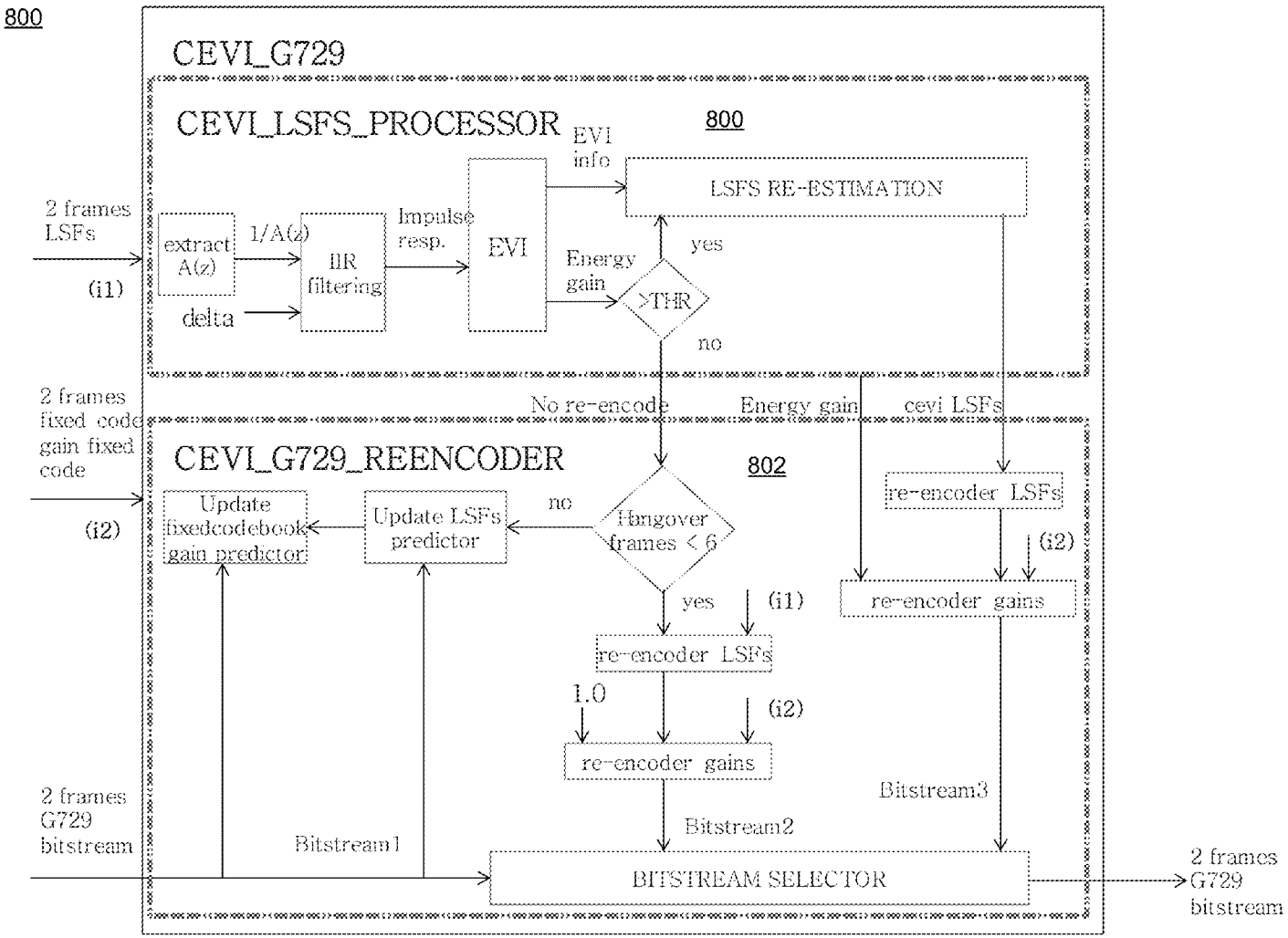
FIG. 8 is a diagrammatic view of a system configured to implement a speech intelligibility process in accordance with an embodiment of the present disclosure.

Referring now to FIGS. 5-7, flowcharts depicting various embodiments of the present disclosure are provided. FIG. 5 shows an embodiment of a high level block diagram of how the building blocks (e.g. EANC, EAEC, EALC and EEVI) are used in the Ethernet Voice Processor ("EVP"). For example, in a two party phone call the EVP may see data coming in from both sides (send in and receive in) and may transmit processed data going out (send out and receive out) to each side. Each of these building blocks are discussed in further detail hereinbelow. Decoder 502 may be a standard CELP decoder that takes in a compressed bitstream and generates audio in the form of PCM samples. Energy based adaptive noise cancellation ("EANC") 504 may be configured to receive in pcm-based audio from a direction and codec parameters like silence indication, pitch, etc and generates a processed pcm based audio that has noise reduced. Energy based adaptive echo cancellation ("EAEC") 506 may be configured to receive in pcm-based audio from both directions (near end and far end) and codec parameters and generate a processed pcm-based audio that has its echo suppressed. Energy based adaptive level control ("EALC") 508 may be configured to receive in pcm-based audio from a direction, codec and audio parameters from both directions and generate a processed pcm based audio with speech level adjusted. Energy based enhanced voice intelligibility ("EEVI") 512 may be configured to receive in pcm-based audio from a direction, codec and audio parameters from both directions and generate a processed pcm based audio that has improved intelligibility. Partial Encoder (Source Params) block 510 may include a CELP-based selective encoder that receives the incoming bitstream, processed audio and other codec parameters to selectively encode portions of the audio where filter parameters are reused from the incoming bitstream. Partial Encoder (Filter Params) 514 may include a CELP-based selective encoder that receives the incoming bistream, processed audio and other codec parameters to selectively encode portions of the audio where source parameters are reused from the incoming bitstream.

In operation, for each direction shown in FIG. 5, a bitstream may be sent in, voice quality assurance ("CVQA") may be performed and the bitstream may be sent out. Here, CVQA may refer to the flow from partial/full decoder 502 to EANC 504 to EAEC 506 to EALC 508 to partial full/encoder 510 to EEVI 512 to partial full encoder 514 as shown in FIG. 5. In some embodiments, only selective modules may be activated within the CVQA. For example, using one or more of the decoder/encoders and the selected module (e.g. EANC, EAEC, EALC, and/or EEVI).

Embodiments included herein may be configured to preserve speech quality on speech with no impairments. In other words, the quality of the output speech should be the same as input speech if the input speech is of a high quality. The speech enhancement process described herein does not simply copying the original bitstream if there are no impairments detected on the call, which may result in single encoding of clean frames but double encoding of enhanced noisy frames. In contrast, the speech enhancement process described herein may use the approach of only partially re-encoding portions of the original bitstream. Accordingly, the difference between the coding effect on high quality speech frames and low quality enhanced frames is more nuanced.

In some embodiments, the partial encoding approach assumes that the compressed speech has been generated using a code-excited linear prediction ("CELP") codec. In some cases, only the fixed codebook gain, fixed codebook index, adaptive codebook gain and adaptive codebook index may be recalculated for the enhanced speech. The pitch and LSF values may be re-used from the original stream.

In some embodiments, the input speech may be decoded and speech enhancement may be performed on the linear speech. The enhanced speech may be passed through the analysis filter computed from the original bitstream LSFs values to obtain the excitation vector. The excitation vector obtained may be compared against the excitation vector obtained from the original bitstream using the original fixed codebook gain, fixed codebook index, adaptive codebook gain and adaptive codebook index. If the excitation vectors are close then the original bitstream may be used. If the excitation vectors are not close then the new gains and indices may be computed. The history of the partial encoder may be carefully updated using the final bitstream values. Accordingly, embodiments of the speech enhancement process ensure that the original speech is left unchanged if it is of high quality.

Referring now to FIGS. 8-12, embodiments depicting a processor and re-encoder consistent with the teachings of the present disclosure are provided. In some embodiments, processor 800 may be configured to transform the input LSFs by applying compressed domain EVI filtering. If the EVI effect is negligible, LSFS_REESTIMATION is not executed, and the "no re-encode" flag shown in FIG. 8 may be marked, which may be used in the CEVI_G729_REENCODER module as is discussed below.

In some embodiments, re-encoder 802 may be configured to re-encode LSFs and/or fixed/adaptive codebook gains. The gains may be modified as the LSFs high pass filter transformation may attenuate the overall audio level. When the "no re-encode" flag is marked, the predictors of the LSFS and gains of the re-encoder may be updated, which may be required to avoid artefacts in the transitions re-encoding/non re-encoding. In some embodiments, a hangover of frames (e.g. six) may be used for transitions from re-encode to "no re-encode" state. During this hangover time the re-encoding may be performed.

In some embodiments, the processor may be configured to Extract A(z) and to determine the LPC filter coefficients from the LSFs. The processor may also be configured to perform infinite impulse response ("IIR") filtering. Accordingly, the processor may extract the impulse response of 1/A(z), by filtering a delta. For example, the amplitude of the delta may be set to 2048. One A(z) filter may be generated for each 5 ms sub-frame in the G.729 codec. In some embodiments, only the second 5 ms A(z) coefficients may be used to filter each 10 ms frame. Two frames of 80 samples each may be concatenated and provided as an input to the EVI module. The processor may also perform EVI filtering, for example, EVI filtering from 160 samples of the impulse response (here the existing module of a voice quality assurance ("VQA") library may be used). In some embodiments, the energy attenuation of the EVI may be compared with a threshold to produce a binary decision that decide if the re-encoding is applied or not (e.g., a threshold of 1.25 was used in certain cases). Some computationally expensive operations are spared if the "no re-encode" flag is set (e.g., correlation, Levinson Durbin algorithm, etc.).

Figure 9:
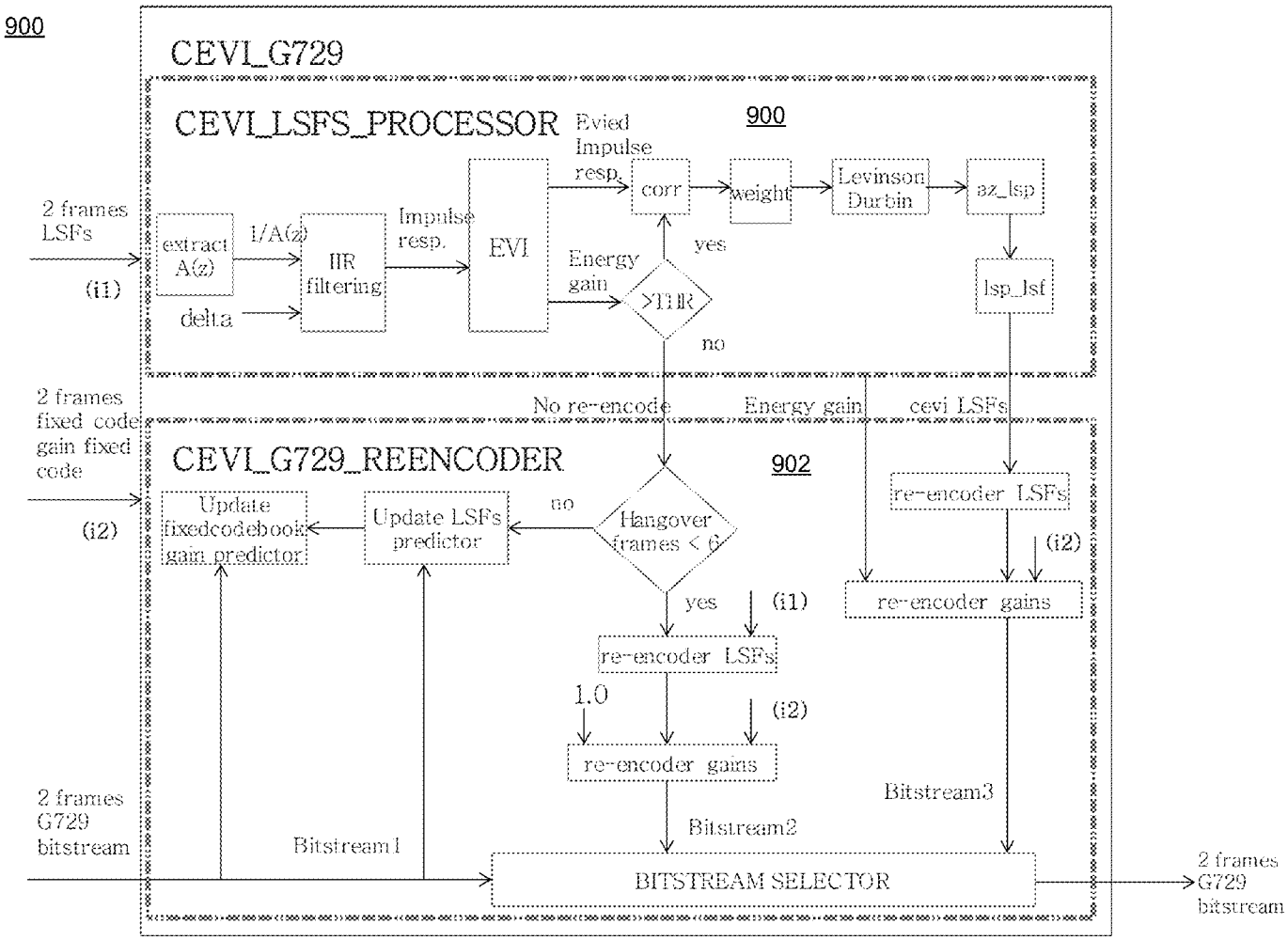
FIG. 9 is a diagrammatic view of a system configured to implement a speech intelligibility process in accordance with an embodiment of the present disclosure.

Referring again to FIGS. 9-12, a number of embodiments of LSF re-estimation with decreasing computational complexity are provided. FIG. 9 depicts an embodiment configured to compute correlation, Levinson Durbin, and re-estimation of LSP from the new LPC filter obtained from the Levinson Durbin algorithm. For example, the 80 samples of each filtered impulse response may be concatenated to compose a 240 samples frame from which the auto-correlation is extracted as shown in processor 900. In this particular example, two correlations may be extracted, one for each 10 ms frame. The output of the correlation module may be received by a weighting module, which may be configured to apply a weighting to the correlation function based on the lag. The Levinson Durbin module may be configured to extract the A(z) coefficients for each one of the two 10 ms frames using the Levinson Durbin algorithm. The az_lsp and lsp_lsf modules may be configured to convert from LPC coefficients to line spectral pairs (LSP), and from LSP to LSFs.

Figure 10:
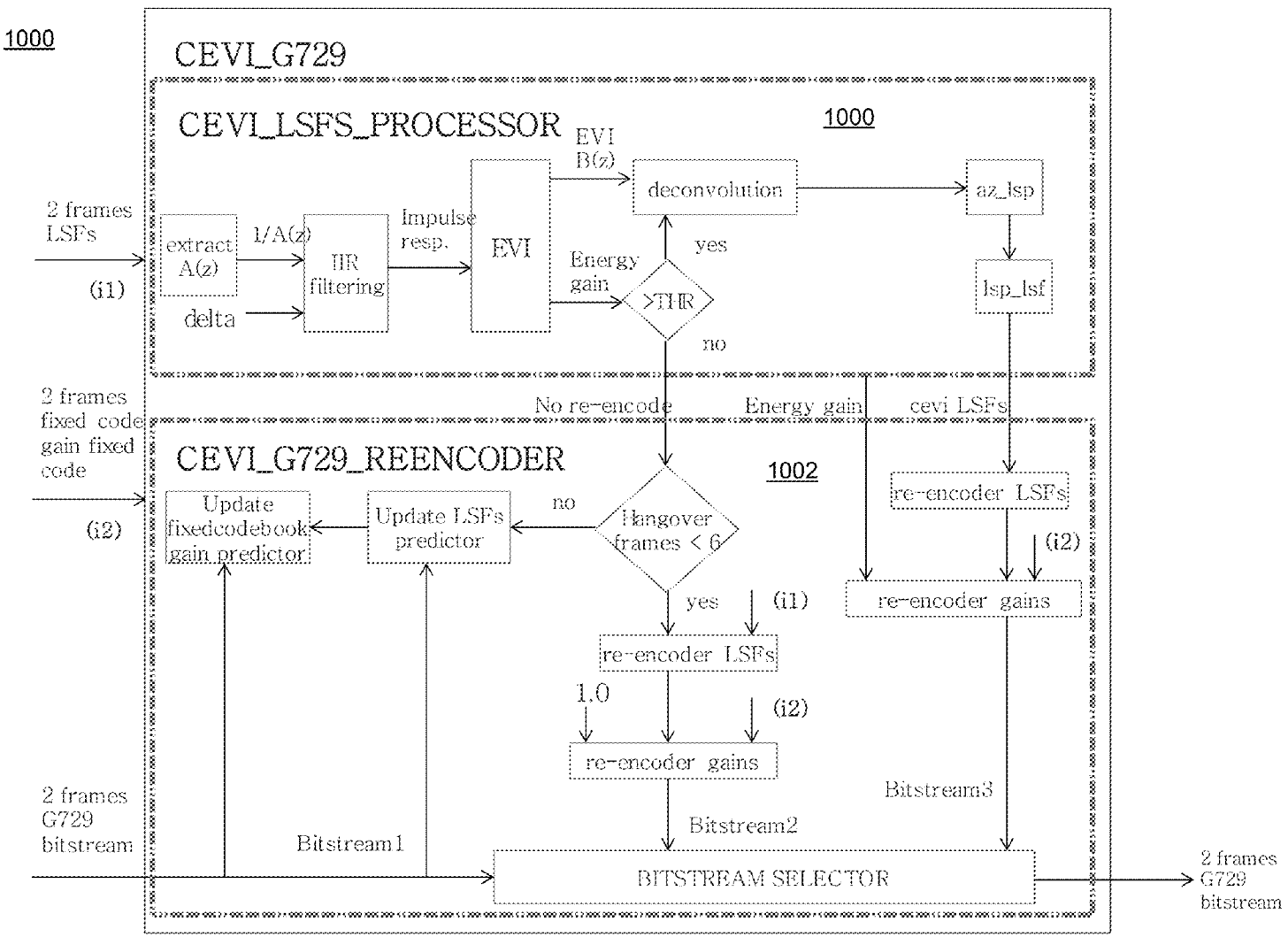
FIG. 10 is a diagrammatic view of a system configured to implement a speech intelligibility process in accordance with an embodiment of the present disclosure.

FIG. 10 depicts an embodiment configured to avoid correlation and Levinson Durbin by applying de-convolution of the EVI filter from the original A(z) filter. In some embodiments, the EVI filter B(z) may be a 1st order high pass FIR filter. The transfer function of the EVI output is H(z)=B(z)/A(z), that should be approximated with an all-pole model H(z)=1/Ap(z) to estimate the new LSFs. Ap(z) can be estimated very efficiently by de-convolution of B(z) from A(z). The de-convolution may be attained by filtering a delta through the IIR filter A(z)/B(z). Some computational cost may be spared in this version by avoiding the az_lsp module that extracts the LSP from the new filter Ap(z).

Figure 11:
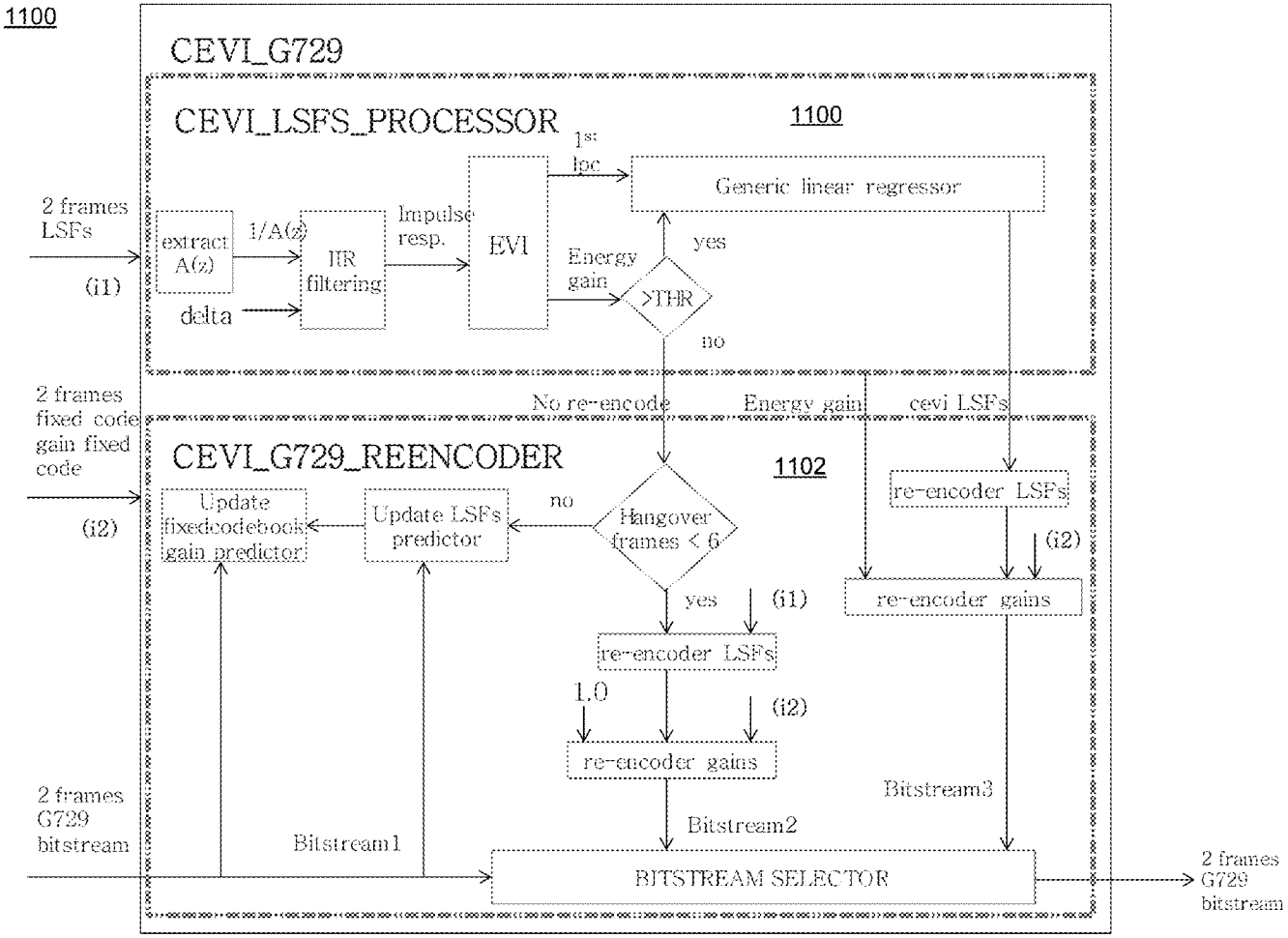
FIG. 11 is a diagrammatic view of a system configured to implement a speech intelligibility process in accordance with an embodiment of the present disclosure.

FIG. 11 depicts an embodiment configured to provide a generic linear regressor that maps from LSFS+1st coefficient LPC to the LSFS post EVI. Avoid the computational cost of az_lsp that is the most expensive part in the re-estimator of FIG. 10. In some embodiments, the generic linear regressor may be configured to perform multivariate linear regression from 10 LSFs+1st LPC coefficient to 10 LSFs. The 1st LPC coefficient may be multiplied by the contribution factor before feeding the linear regressor. Two generic models trained for low-bit rate ("LBR") enhancement enabled/disabled with 30 hours of audio from voicemail to text (e.g. VM2T available from the assignee of the present disclosure), using several contribution factors.

Figure 12:
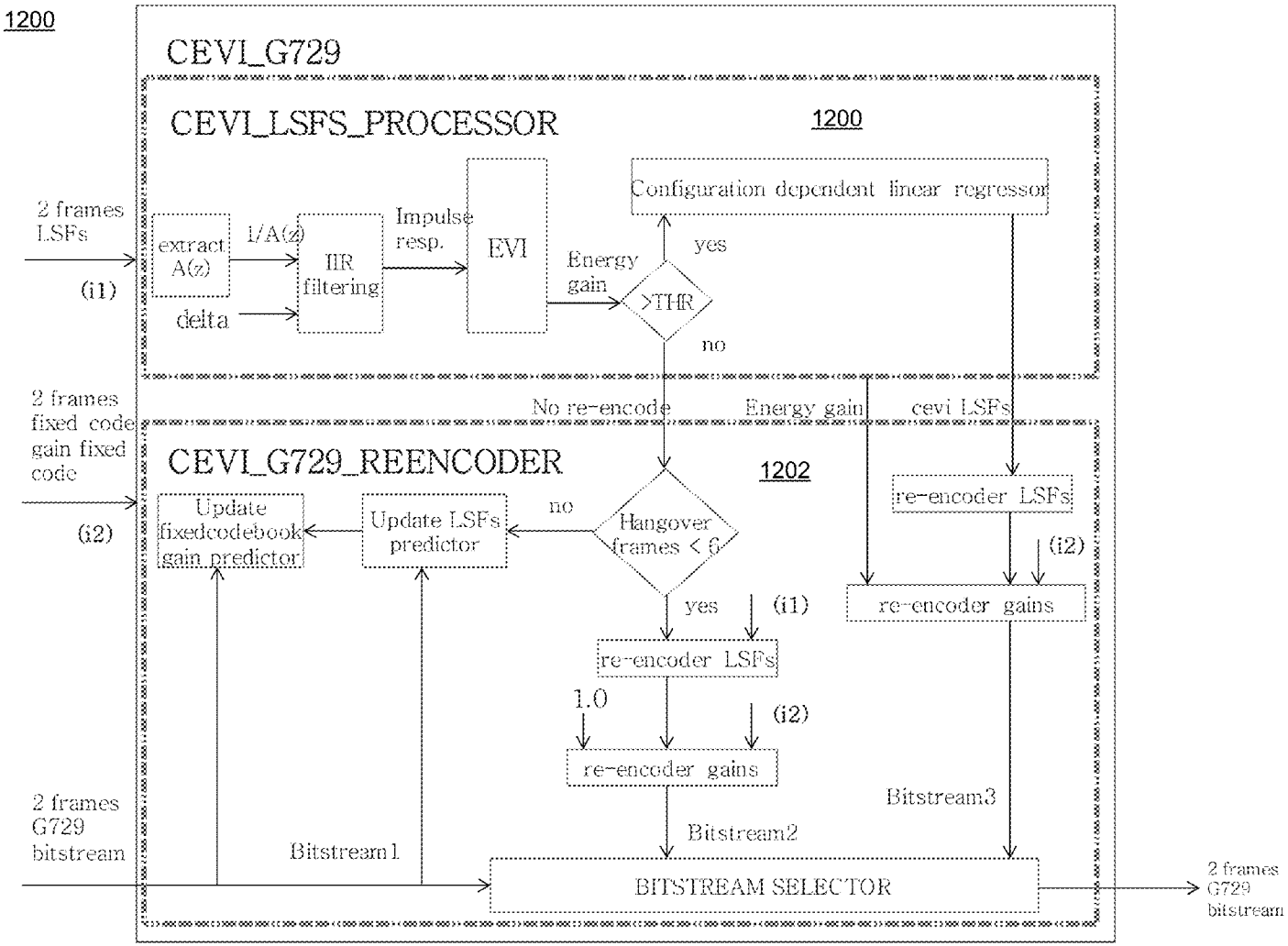
FIG. 12 is a diagrammatic view of a system configured to implement a speech intelligibility process in accordance with an embodiment of the present disclosure.

FIG. 12 depicts an embodiment showing a configuration dependent linear regressor that transform from LSFS to LSFS post EVI. The configuration dependent linear regressor may be configured to perform multivariate linear regression from 10 LSFs to 10 LSFs. For example, 8 models may be trained for the following combinations: LBR enhancement enabled/disabled and contributions 25%, 50%, 75% and 100%. Each configuration dependent linear regressor model may be trained with hours of audio from voicemail to text.

Figure 13:
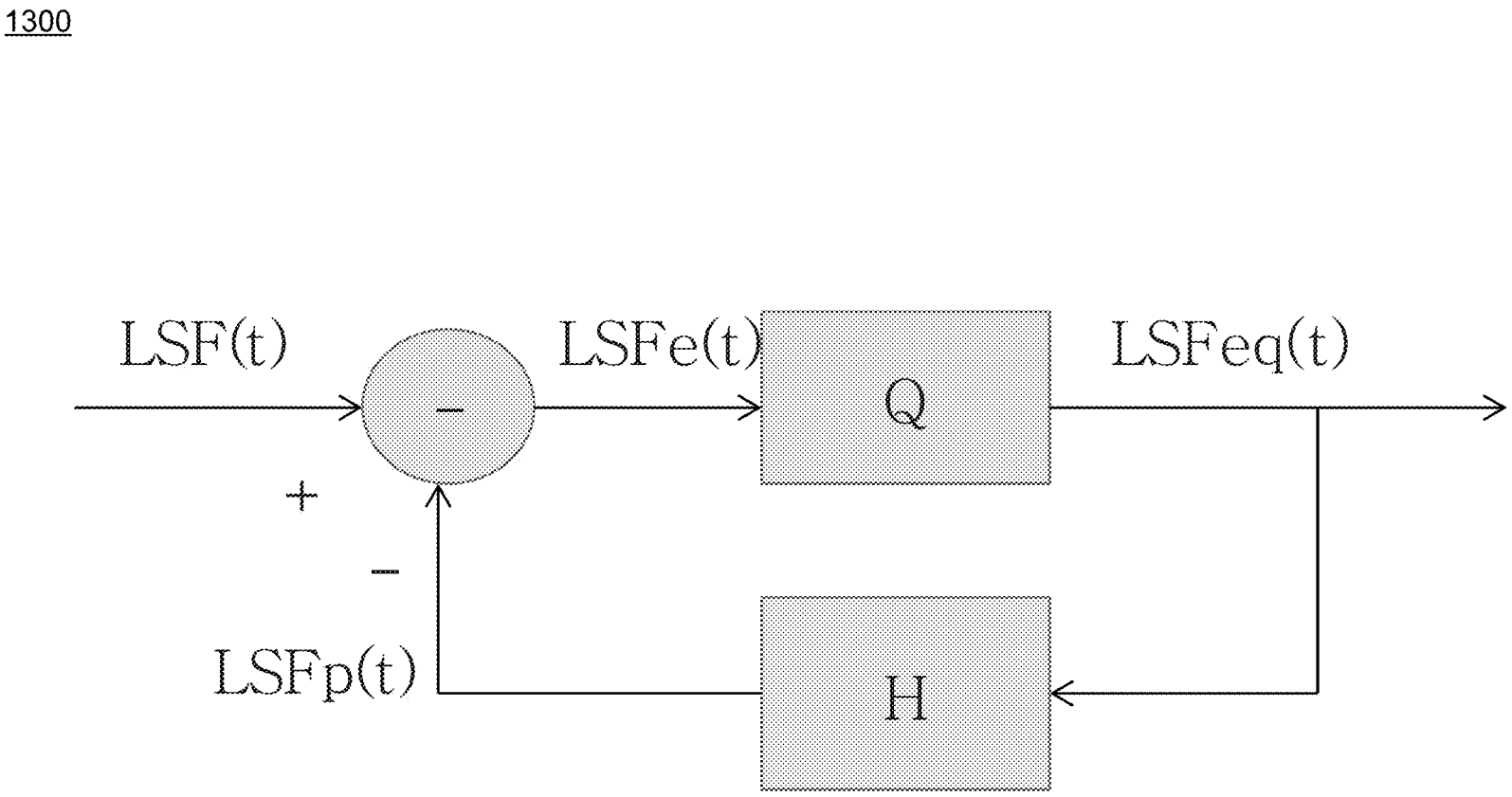
FIG. 13 is a diagrammatic view of a system configured to implement a speech intelligibility process in accordance with an embodiment of the present disclosure.

Referring now to FIG. 13, an embodiment of a re-encoder is provided. The set of 10 LSFs coefficients are re-encoded each frame by using the same algorithm defined in the G729 standard. The encoder may be a two-stage predictive vector quantizer that uses the quantized prediction errors (LSFeq) to predict the LSFs of future frames. The best combination of predictor H and codewords Q are chosen and sent out to the decoder. There are two predictors H, each one is a 4 order linear predictor. Q may be implemented in a two stage vector quantizer.

Figure 14:
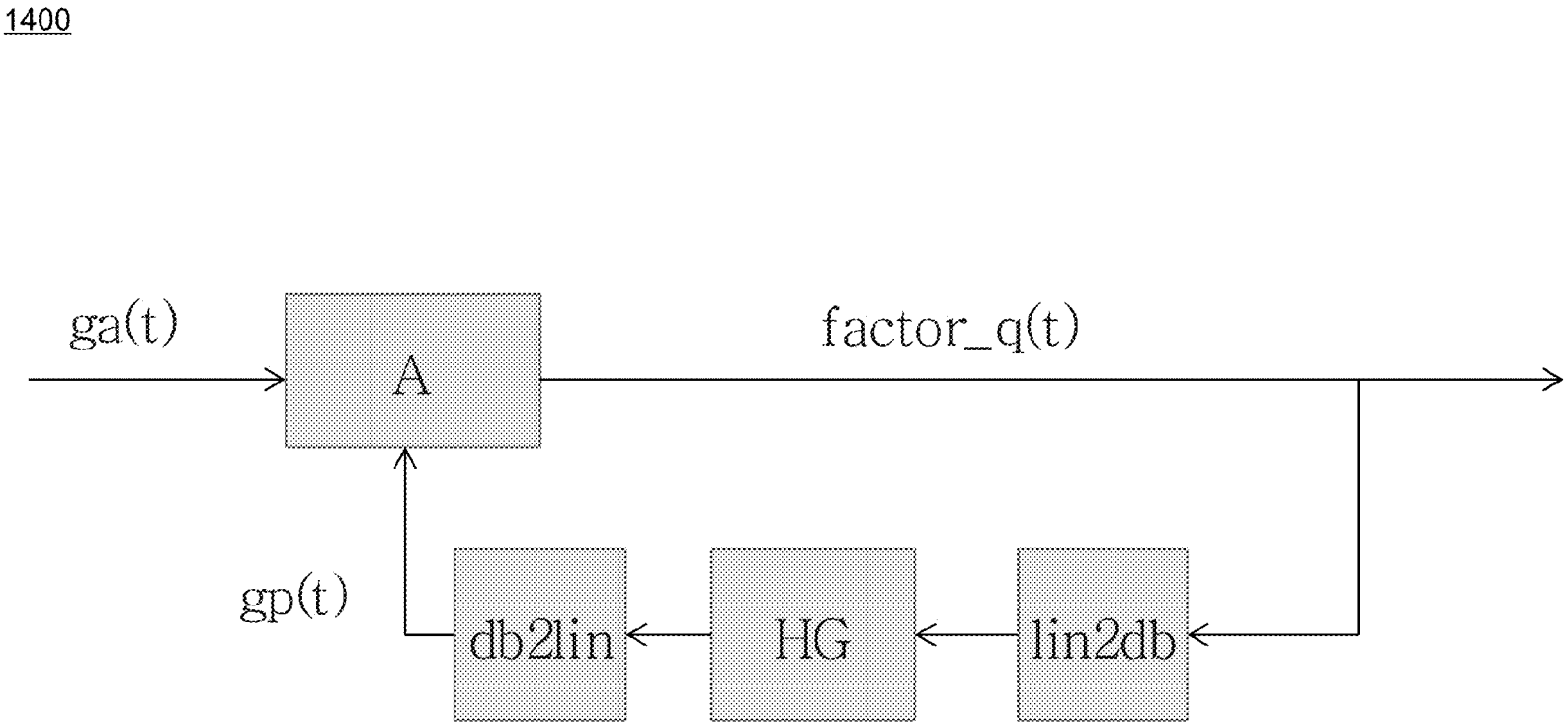
FIG. 14 is a diagrammatic view of a system configured to implement a speech intelligibility process in accordance with an embodiment of the present disclosure.

Referring now to FIG. 14, an embodiment of a re-encoder of gains is provided. The G.729 encoder makes use of the PCM to encode the fixed and adaptive codebook gains, by using a conjugated-structure predictive vector quantizer. As in the CEVI algorithm the PCM is not available, an alternative algorithm was defined and implemented. This approach may be configured to amplify the original fixed codebook gain g(t), to produce a target fixed codebook gain ga(t), by using the amp_factor, ga(t)=amp_factor*g(t), and performs an exhaustive search in the conjugated-structure codebooks to match the new target fixed codebook gain. The encoder A may be a vector quantizer that contains a pair of adaptive/fixed codebook quantized values in each entry. The error that is minimized in A is:

$$err = err_\text{fixed}cb + err_\text{adaptive}cb$$

$$err_\text{adaptive}cb = ((Ga(t) - Gaq(t))/Ga(t))\hat{}2;$$

$$err_\text{fixed}cb = ((ga(t) - \text{factor}_q(t)*gp(t))/ga(t))\hat{}2;$$

Where Ga(t) is the target adaptive codebook gain, Gaq(t) is the quantized entry of the adaptive codebook gain contained in A and ga(t) is the amplified target fixed codebook gain, gp(t) is the predicted fixed codebook gain, and factor_q(t) is the quantized entry searched in A The term searched in A that involves the fixed codebook gain, factor_q(t), may attempt to fit the following equation: ga(t)=factor_q(t)*gp(t), where gp(t) is the predicted fixed codebook gain and ga(t) is the target fixed codebook gain that has been amplified. The predictor HG may be a 4th order moving average filter that uses the previous quantized gains to work out the current gain. The prediction is carried out with the gains in logarithmic scale, before HG the module lin2 db converts to logarithmic scale, and after HG, the block db2lin performs the inverse operation converting from logarithmic to linear scale.

In some embodiments, an update fixed codebook gain predictor and an update LSFs predictor may be employed. The fixed codebook gain predictor history of HG is updated with the decoded fixed codebook gain entries factor_q(t) from A. The predictor history should not be updated with the decoded fixed codebook gains. The LSFs predictor history of H may be updated with the decoded quantized prediction error of the LSFs. The predictor history should not be updated with the decoded LSFs.

Embodiments of the present disclosure may also include a zero delay speech enhancement for arbitrary frame sizes. Speech processing or speech recognition algorithms inherently work on a frame size. For example, the standard frame size is typically 10 ms. This arises because speech processing requires a frame of data for determination of relationships between samples for either compression or recognition. The relationship is established over a group of speech samples called a frame. However, there are certain kinds of processing which are completely sample based. For example, application of gain per sample or G.711 μ-law or a-law compression where no relationship between neighboring samples is exploited.

The possibility of frame size changes mid-stream also complicates the framework design with circular buffer especially when the speech enhancement device is supposed to behave transparently at the packet level. This raises an issue because tandem application of speech processing algorithms operating on different frame sizes that are not simple multiples of each other (e.g. 20 ms and 30 ms) requires the insertion of a circular buffer and deliberate insertion of delay in the signal to allow each algorithm to operate on its own frame size. This becomes a problem in network based speech enhancement devices that have an inherent frame size built in. In VoIP networks carrying G.711 speech compression frame size can be an arbitrary size (e.g., occasionally 12 ms even though the chances of this happening are very rare) and this clashes with the frame size used internally in the speech enhancement device. In such situations, the device ends up inserting delay in the delay (e.g. initial zeros) when ideally none is desired.

Accordingly, embodiments of the zero delay speech enhancement approach described herein may include an algorithm that works on a sample by sample basis that allows the algorithm to process speech for arbitrary frame sizes. This way every frame may be processed as received instead of going through a circular buffer that introduces a delay into the signal path. The framework design also becomes very simple and can handle arbitrary frame size changes mid-stream.

In this way, embodiments of the present disclosure may split the analysis and synthesis portions of speech enhancement therefore allowing for signal processing with absolutely no delay inserted into the signal path. The analysis part that requires frame sizes can be retained. However, the synthesis portion may be implemented using a filter bank. An advantage of using a filter bank is that the signal may be manipulated sample by sample and this allows the signal to be processed with any arbitrary frame size.

Embodiments disclosed here may allow for the retention of the analysis part of speech enhancement that is frame based. For example, FFT-based spectral subtraction or frame based LPC analysis. By using time domain filtering methods all enhancement is applied sample by sample. For example, the gain curve being applied in the frequency domain using FFTs may be applied by weighting individual filter contributions in the synthesis portion of the filter bank. By splitting the analysis and synthesis from each other the enhancement applied may be slightly delayed. For example, the enhancement applied on the current frame is determined by analyzing the previous frame. It should be noted that even though the analysis applied is delayed there is no delay in the signal path itself.

Figure 15:
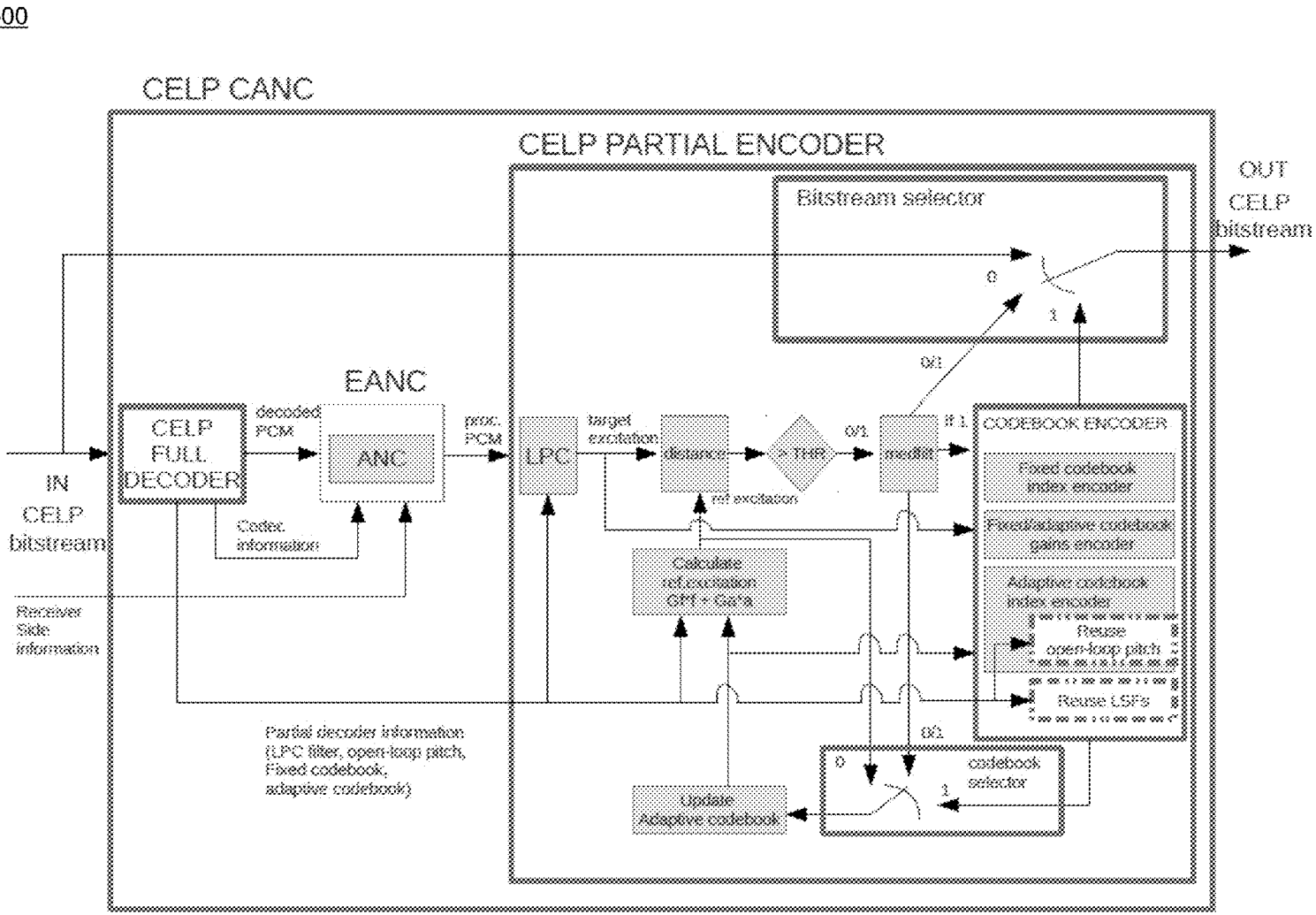
FIG. 15 is a diagrammatic view of a system configured to implement a speech intelligibility process in accordance with an embodiment of the present disclosure.

Referring now to FIG. 15, embodiments of the present disclosure may utilize one or more adaptive noise cancellation ("ANC") techniques. In this particular embodiment, a full decoder and energy parameter ANC ("EANC") and a partial encoder are provided. Accordingly, the full decoder and EANC may be applied to the fully decoded PCM by using codec information that may include, but is not limited to, noise estimations from SID packets, and information from the other side of the call. The partial encoder may be configured to perform a partial encoding of the fixed-codebook gains, fixed codebook index, adaptive codebook gains and adaptive codebook index as necessary. The selective encoder extracts the target excitation from the fully decoded PCM processed with ANC. The decoded LSP coefficients may be used to extract the LPC filter to obtain the target excitation. A distance between the target excitation and a long term averaged decoded excitation, (excitation history) may be measured and compared with a fixed threshold, such that the re-encoding may only be applied when this distance is above the threshold.

The LSP parameters of the decoding are kept and not re-encoded again, and the open-loop pitch estimation of the decoder is kept.

Figure 16:
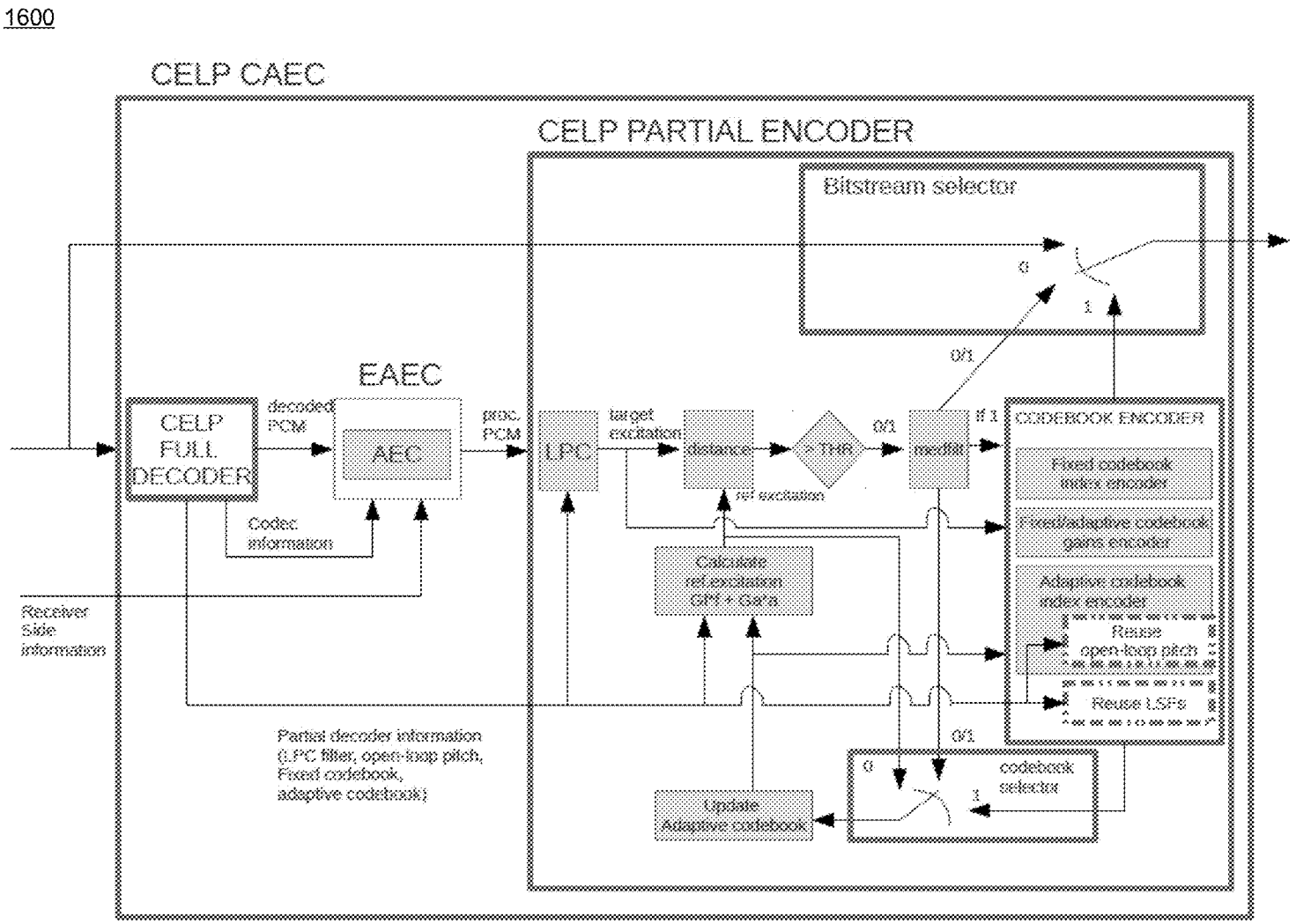
FIG. 16 is a diagrammatic view of a system configured to implement a speech intelligibility process in accordance with an embodiment of the present disclosure.

Referring now to FIG. 16, embodiments of the present disclosure may utilize one or more acoustic echo cancellation ("AEC") techniques. In this particular embodiment, a full decoder and energy parameter AEC ("EAEC") and a partial encoder are provided. Accordingly, the full decoder and EAEC may be applied to the fully decoded PCM by using codec information that may include, but are not limited to, noise estimations from SID packets, and information from the other side of the call. The partial encoder may be configured to perform a partial encoding of the fixed-codebook gains, fixed codebook index, adaptive codebook gains and adaptive codebook index when required. The selective encoder extracts the target excitation from the fully decoded PCM processed with AEC. The decoded LSP coefficients may be used to extract the LPC filter to obtain the target excitation. A distance between the target excitation and a long term averaged decoded excitation, (excitation history) may be measured and compared with a fixed threshold, such that the re-encoding may only be applied when this distance is above the threshold. The LSP parameters of the decoding are kept and not re-encoded again, and the open-loop pitch estimation of the decoder is kept.

Figure 17:
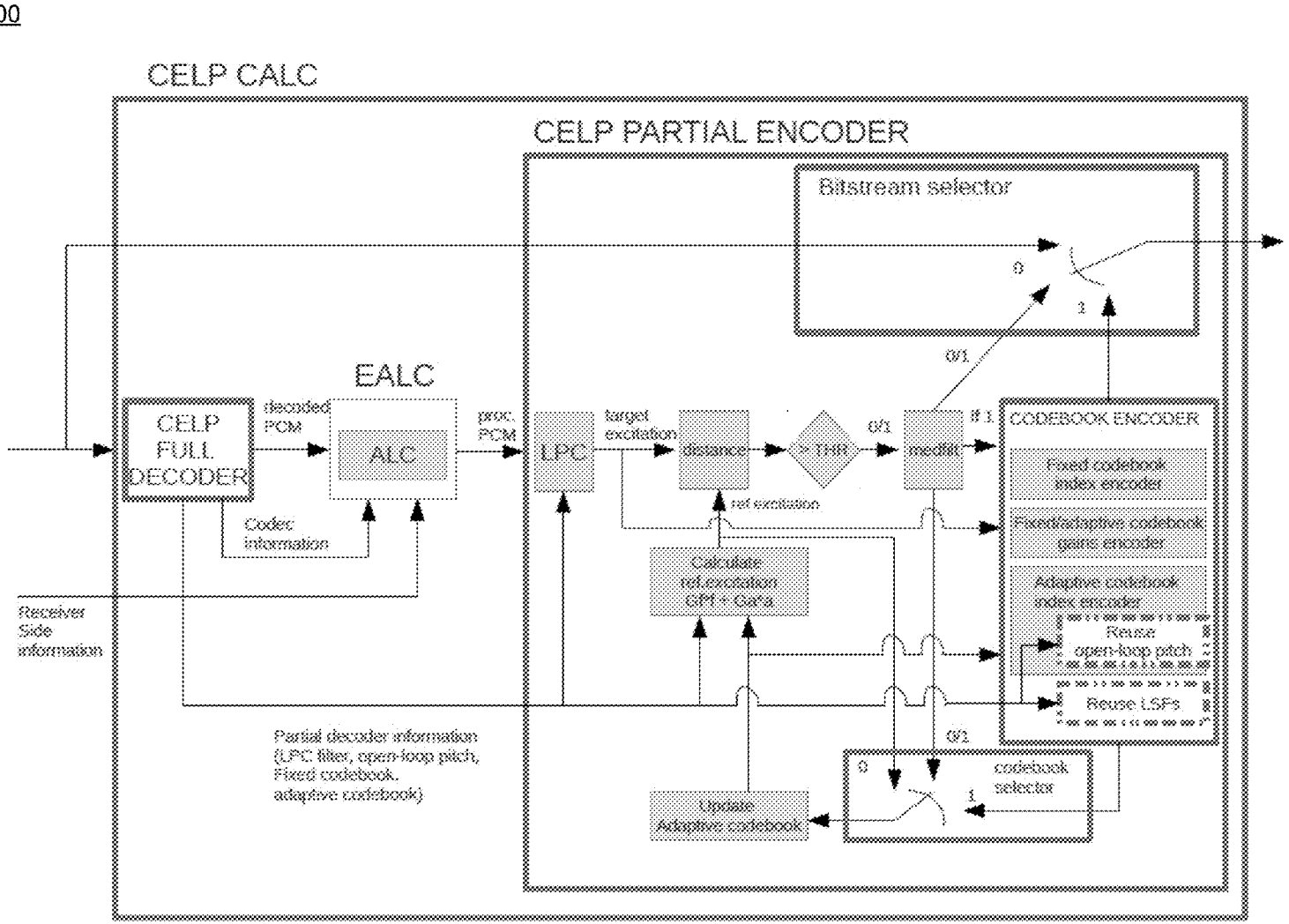
FIG. 17 is a diagrammatic view of a system configured to implement a speech intelligibility process in accordance with an embodiment of the present disclosure.

Referring now to FIG. 17, embodiments of the present disclosure may utilize one or more automatic level control ("ALC") techniques. In this particular embodiment, a full decoder and energy parameter ALC ("EALC") and a partial encoder are provided. Accordingly, the full decoder and EALC may be applied to the fully decoded PCM by using codec information that may include, but is not limited to, noise estimations from SID packets, and information from the other side of the call. The partial encoder may be configured to perform a partial encoding of the fixed-codebook gains, fixed codebook index, adaptive codebook gains and adaptive codebook index when required. The selective encoder extracts the target excitation from the fully decoded PCM processed with ALC. The decoded LSP coefficients are used to extract the LPC filter to obtain the target excitation. A distance between the target excitation and a long term averaged decoded excitation, (excitation history) may be measured and compared with a fixed threshold, such that the re-encoding is only applied when this distance is above the threshold. The LSP parameters of the decoding are kept and not re-encoded again, and the open-loop pitch estimation of the decoder is kept.

In some embodiments, the ANR, ALC, AEC, and EVI techniques described herein may be configured to operate on PCM in and PCM out. The EANC, EALC, EAEC, and EEVI techniques may be configured to receive PCM and other codec level parameters and generate PCM out. In this way, embodiments of the present disclosure may support discontinuous transmission in networks and also maintain the integrity of the bitrate coming in to going out. The CANC, CAEC, CALC, and CEVI approaches may be configured to receive an encoded bitstream and generate encoded bitstream out. In some embodiments, the CANC may utilize the EANC, which in turn may utilize the ANR approach.

Figure 18:
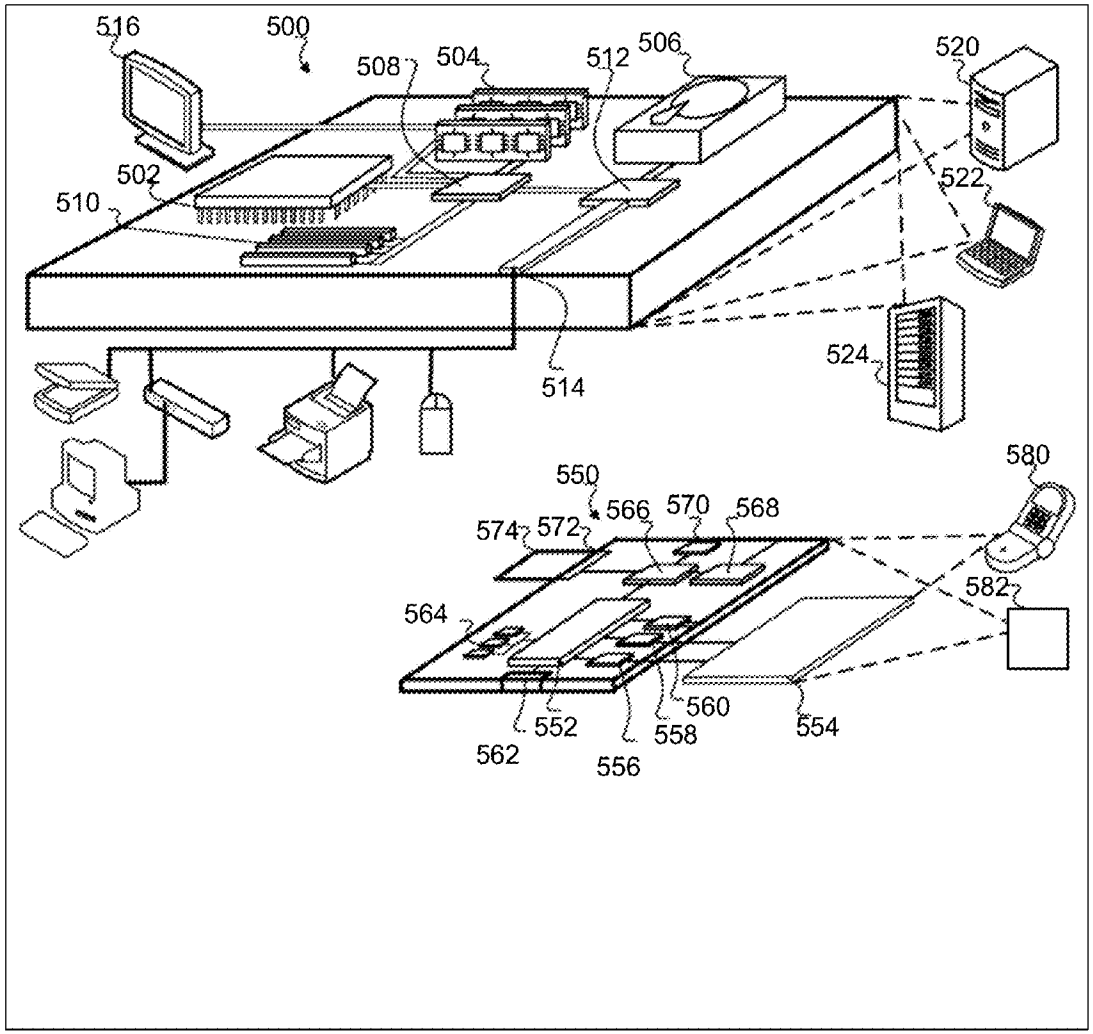
FIG. 18 shows an example of a computer device and a mobile computer device that can be used to implement embodiments of the present disclosure.

Referring now to FIG. 18, an example of a generic computer device 1800 and a generic mobile computer device 550, which may be used with the techniques described herein is provided. Computing device 1800 is intended to represent various forms of digital computers, such as tablet computers, laptops, desktops, workstations, personal digital assistants, servers, blade servers, mainframes, and other appropriate computers. In some embodiments, computing device 550 can include various forms of mobile devices, such as personal digital assistants, cellular telephones, smartphones, and other similar computing devices. Computing device 550 and/or computing device 1800 may also include other devices, such as televisions with one or more processors embedded therein or attached thereto. The components shown here, their connections and relationships, and their functions, are meant to be exemplary only, and are not meant to limit implementations of the inventions described and/or claimed in this document.

In some embodiments, computing device 1800 may include processor 502, memory 504, a storage device 506, a high-speed interface 508 connecting to memory 504 and high-speed expansion ports 510, and a low speed interface 512 connecting to low speed bus 514 and storage device 506. Each of the components 502, 504, 506, 508, 510, and 512, may be interconnected using various busses, and may be mounted on a common motherboard or in other manners as appropriate. The processor 502 can process instructions for execution within the computing device 1800, including instructions stored in the memory 504 or on the storage device 506 to display graphical information for a GUI on an external input/output device, such as display 516 coupled to high speed interface 508. In other implementations, multiple processors and/or multiple buses may be used, as appropriate, along with multiple memories and types of memory. Also, multiple computing devices 1800 may be connected, with each device providing portions of the necessary operations (e.g., as a server bank, a group of blade servers, or a multi-processor system).

Memory 504 may store information within the computing device 1800. In one implementation, the memory 504 may be a volatile memory unit or units. In another implementation, the memory 504 may be a non-volatile memory unit or units. The memory 504 may also be another form of computer-readable medium, such as a magnetic or optical disk.

Storage device 506 may be capable of providing mass storage for the computing device 1800. In one implementation, the storage device 506 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 504, the storage device 506, memory on processor 502, or a propagated signal.

High speed controller 508 may manage bandwidth-intensive operations for the computing device 1800, while the low speed controller 512 may manage lower bandwidth-intensive operations. Such allocation of functions is exemplary only. In one implementation, the high-speed controller 508 may be coupled to memory 504, display 516 (e.g., through a graphics processor or accelerator), and to high-speed expansion ports 510, which may accept various expansion cards (not shown). In the implementation, low-speed controller 512 is coupled to storage device 506 and low-speed expansion port 514. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

Computing device 1800 may be implemented in a number of different forms, as shown in the figure. For example, it may be implemented as a standard server 520, or multiple times in a group of such servers. It may also be implemented as part of a rack server system 524. In addition, it may be implemented in a personal computer such as a laptop computer 522. Alternatively, components from computing device 1800 may be combined with other components in a mobile device (not shown), such as device 550. Each of such devices may contain one or more of computing device 1800, 550, and an entire system may be made up of multiple computing devices 1800, 550 communicating with each other.

Computing device 550 may include a processor 552, memory 564, an input/output device such as a display 554, a communication interface 566, and a transceiver 568, among other components. The device 550 may also be provided with a storage device, such as a microdrive or other device, to provide additional storage. Each of the components 550, 552, 564, 554, 566, and 568, may be interconnected using various buses, and several of the components may be mounted on a common motherboard or in other manners as appropriate.

Processor 552 may execute instructions within the computing device 550, including instructions stored in the memory 564. The processor may be implemented as a chipset of chips that include separate and multiple analog and digital processors. The processor may provide, for example, for coordination of the other components of the device 550, such as control of user interfaces, applications run by device 550, and wireless communication by device 550.

In some embodiments, processor 552 may communicate with a user through control interface 558 and display interface 556 coupled to a display 554. The display 554 may be, for example, a TFT LCD (Thin-Film-Transistor Liquid Crystal Display) or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may be provide in communication with processor 552, so as to enable near area communication of device 550 with other devices. External interface 562 may provide, for example, for wired communication in some implementations, or for wireless communication in other implementations, and multiple interfaces may also be used.

In some embodiments, memory 564 may store information within the computing device 550. The memory 564 can be implemented as one or more of a computer-readable medium or media, a volatile memory unit or units, or a non-volatile memory unit or units. Expansion memory 574 may also be provided and connected to device 550 through expansion interface 572, which may include, for example, a SIMM (Single In Line Memory Module) card interface. Such expansion memory 574 may provide extra storage space for device 550, or may also store applications or other information for device 550. Specifically, expansion memory 574 may include instructions to carry out or supplement the processes described above, and may include secure information also. Thus, for example, expansion memory 574 may be provide as a security module for device 550, and may be programmed with instructions that permit secure use of device 550. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product may contain instructions that, when executed, perform one or more methods, such as those described above. The information carrier may be a computer- or machine-readable medium, such as the memory 564, expansion memory 574, memory on processor 552, or a propagated signal that may be received, for example, over transceiver 568 or external interface 562.

Device 550 may communicate wirelessly through communication interface 566, which may include digital signal processing circuitry where necessary. Communication interface 566 may provide for communications under various modes or protocols, such as GSM voice calls, SMS, EMS, or MMS speech recognition, CDMA, TDMA, PDC, WCDMA, CDMA2000, or GPRS, among others. Such communication may occur, for example, through radio-frequency transceiver 568. In addition, short-range communication may occur, such as using a Bluetooth, WiFi, or other such transceiver (not shown). In addition, GPS (Global Positioning System) receiver module 570 may provide additional navigation- and location-related wireless data to device 550, which may be used as appropriate by applications running on device 550.

Device 550 may also communicate audibly using audio codec 560, which may receive spoken information from a user and convert it to usable digital information. Audio codec 560 may likewise generate audible sound for a user, such as through a speaker, e.g., in a handset of device 550. Such sound may include sound from voice telephone calls, may include recorded sound (e.g., voice messages, music files, etc.) and may also include sound generated by applications operating on device 550.

Computing device 550 may be implemented in a number of different forms, as shown in the figure. For example, it may be implemented as a cellular telephone 580. It may also be implemented as part of a smartphone 582, personal digital assistant, remote control, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

As will be appreciated by one skilled in the art, the present disclosure may be embodied as a method, system, or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present disclosure may take the form of a computer program product on a computer-usable storage medium having computer-usable program code embodied in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the present disclosure may be written in an object oriented programming language such as Java, Smalltalk, C++ or the like. However, the computer program code for carrying out operations of the present disclosure may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

The present disclosure is described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here may be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

Having thus described the disclosure of the present application in detail and by reference to embodiments thereof, it will be apparent that modifications and variations are possible without departing from the scope of the disclosure defined in the appended claims.

What is claimed is:

1. A method for speech intelligibility comprising:

receiving, at one or more computing devices, a first speech input from a first user;

performing voice activity detection upon the first speech input;

calculating one or more linear prediction coefficients; and analyzing a spectral tilt associated with the first speech input, wherein analyzing includes computing an impulse response of a linear predictive coding ("LPC") synthesis filter in a linear pulse code modulation ("PCM") domain and wherein the one or more computing devices includes an adaptive high pass filter configured to recalculate the one or more linear prediction coefficients.

2. The method of claim 1, wherein the one or more recalculated linear prediction coefficients includes at least one of a line spectral frequency ("LSF") and a linear prediction coefficient ("LPC").

3. The method of claim 2, further comprising:

partially decoding a bit stream associated with the first speech input based upon, at least in part, at least one of the line spectral frequency ("LSF") and the linear prediction coefficient ("LPC").

4. The method of claim 1, wherein the spectral tilt includes a ratio of frame energies between a low-pass and high-pass version of a portion of the first speech input.

5. The method of claim 1, wherein the adaptive high pass filter is a two-tap finite impulse response ("FIR") filter.

6. The method of claim 1, further comprising:

determining if the first speech signal is a voiced speech signal using an unvoiced speech detection module.

7. The method of claim 1 further comprising:

performing an input power estimation analysis and a gain calculation analysis to determine an input power level and an output power level.

8. The method of claim 7, further comprising:

determining a final speech output based upon, at least in part, a weighted average of an output of the adaptive high-pass filter and the gain calculation analysis.

9. A system for speech intelligibility comprising:

one or more computing devices configured to receive a first speech input from a first user and to perform voice activity detection upon the first speech input and to calculate one or more linear prediction coefficients, the one or more computing devices further configured to analyze a spectral tilt associated with the first speech input, wherein analyzing includes computing an impulse response of a linear predictive coding ("LPC") synthesis filter in a linear pulse code modulation ("PCM") domain and wherein the one or more computing devices includes an adaptive high pass filter configured to recalculate the one or more linear prediction coefficients.

10. The system of claim 9, wherein the one or more recalculated linear prediction coefficients includes at least one of a line spectral frequency ("LSF") and a linear prediction coefficient ("LPC").

11. The system of claim 10, further comprising:

partially decoding a bit stream associated with the first speech input based upon, at least in part, at least one of the line spectral frequency ("LSF") and the linear prediction coefficient ("LPC").

12. The system of claim 9, wherein the spectral tilt includes a ratio of frame energies between a low-pass and high-pass version of a portion of the first speech input.

13. The system of claim 9, wherein the adaptive high pass filter is a two-tap finite impulse response ("FIR") filter.

14. The system of claim 9, further comprising:

determining if the first speech signal is a voiced speech signal using an unvoiced speech detection module.

15. The system of claim 9, further comprising:

performing an input power estimation analysis and a gain calculation analysis to determine an input power level and an output power level.

16. The system of claim 15, further comprising:

determining a final speech output based upon, at least in part, a weighted average of an output of the adaptive high-pass filter and the gain calculation analysis.

17. A method comprising:

receiving, at one or more computing devices, a first speech input from a first user;

decoding the first speech input;

performing speech enhancement on the first speech input to generate an enhanced speech signal;

receiving the enhanced speech signal at an analysis filter configured to generate an excitation vector;

comparing the excitation vector to an original excitation vector obtained from an original bitstream to determine a final bitstream value; and updating a partial encoder based upon, at least in part, the final bitstream value.

18. The method of claim 17, wherein comparing includes comparing at least one of an original fixed codebook gain, a fixed codebook index, an adaptive codebook gain, and an adaptive codebook index.

19. The method of claim 17, wherein the analysis filter is computed from the original bitstream line spectral frequency ("LSF").

20. The method of claim 17, wherein if the excitation vector and the original excitation vector are within a certain threshold then the original bitstream is the final bitstream value and if the excitation vector and the original excitation vector are outside of the certain threshold then a new gain is computed prior to generating the final bitstream value.

* * * * *